US008973938B2

(12) United States Patent
Beck et al.

(10) Patent No.: US 8,973,938 B2
(45) Date of Patent: Mar. 10, 2015

(54) UNIVERSAL FOOT TRAY FOR WHEELCHAIRS

(71) Applicant: Linda Beck, Geneva, NY (US)

(72) Inventors: Linda Beck, Geneva, NY (US); Frank DeWitt, Bloomfield, NY (US)

(73) Assignee: Linda Beck, Geneva, NY (US)

( * ) Notice: Subject to any disclaimer, the term of this patent is extended or adjusted under 35 U.S.C. 154(b) by 0 days.

(21) Appl. No.: 13/795,102

(22) Filed: Mar. 12, 2013

(65) Prior Publication Data

US 2014/0265234 A1 Sep. 18, 2014

(51) Int. Cl.
*A61G 5/12* (2006.01)

(52) U.S. Cl.
CPC ..... *A61G 5/12* (2013.01)
USPC ..... 280/291; 280/250.1; 280/304.1

(58) Field of Classification Search
CPC ..... A61G 5/00; A61G 5/08
USPC ..... 180/907; 280/250.1, 304.1; 297/68, 71, 297/423.26, 423.19, 423.22, 423.23, 297/423.24, 423.27
See application file for complete search history.

(56) References Cited

U.S. PATENT DOCUMENTS

| | | | | |
|---|---|---|---|---|
| 5,233,708 | A * | 8/1993 | Winston, Sr. | 5/81.1 R |
| 6,375,209 | B1 * | 4/2002 | Schlangen | 280/250.1 |
| 6,769,705 | B1 * | 8/2004 | Schlangen | 280/250.1 |
| 2010/0244534 | A1 * | 9/2010 | Driessen et al. | 297/423.35 |

* cited by examiner

*Primary Examiner* — Joseph Rocca
*Assistant Examiner* — Jacob Knutson
(74) *Attorney, Agent, or Firm* — Brown & Michaels, PC

(57) ABSTRACT

A universal tray apparatus includes a tray and mounting components. The mounting components preferably include at least one arm that connects to the tray, as well as at least one mounting portion that can be reversibly fastened to an existing portion of a wheelchair. One or more of the arms between the tray and the mounting portion is preferably made such that it can retract and extend, depending upon where the person using the tray apparatus prefers the tray to be in relation to the wheelchair.

15 Claims, 28 Drawing Sheets

35°
Ø.150

SLOT .281 WIDE
.2 LONG
AS SHOWN
.20
30°

Ø.875
Ø.875
F
F
.281
7.95
1.60
8.0
4.80
Ø.188
7.000
12.5
E
E
216
R1.5

UNIVERSAL FOOT TRAY FOR WHEELCHAIRS

BACKGROUND OF THE INVENTION

1. Field of the Invention

The invention pertains to the field of wheelchairs. More particularly, the invention pertains to a universal foot tray for wheelchairs.

2. Description of Related Art

As of 1993, there were 35 million people in nursing homes worldwide. In 2004, there were approximately 1.5 million people in nursing homes in the US. Many of these people have mobility issues, and require the use of a wheelchair.

Conventional wheelchairs include two foot pedals that can be flipped to the side when not in use. An example of a wheelchair 1 with prior art foot pedals 2 is shown in FIG. 1. The wheelchair 1 includes a seat 3, a back 4 and side panels 13. The wheelchair 1 also includes an armrest 5 and an arm 6. It includes two wheels 7 with hand rims 8, as well as smaller wheels or casters 9. A cross brace 10 is the mechanism that collapses the chair 1 and a brake or wheel lock 12 permits the user to lock the wheelchair 1 in place. A push handle or hand grip 14 permits another person to push the wheelchair 1. Front rigging 11 connects the foot plate 2 to the rest of the wheelchair 1. The foot pedals 2 are also removable from the wheelchair 1.

Pedals 2 for wheelchairs come in "left foot" pedals and "right foot" pedals, as well as elevating pedals (the pedals 2 in FIG. 1 are examples of elevating pedals 2 with calf rests 16). While foot pedals 2 can be useful, they are not useful for everyone at all times, and often they are removed. Sometimes, something is needed to assist, or to keep the feet safe, during transport. Unfortunately, when the foot pedals 2 are flipped up, the user of the wheelchair 1 can not access the brake 12 or the hand rim 8 anymore. In designs where the pedals are flipped out when not in use, the rods stick out causing problems.

In addition, since the foot pedals 2 are removable, they can get misplaced, and are heavy to remove and reinstall. One reason to remove the foot pedals 2 is to allow the user to maintain leg strength and mobility. Each foot pedal 2 is approximately six pounds, and there are at least three different manufacturers of foot pedals. If pedals 2 are removed and left on the floor, they become a tripping hazard. In a nursing home, the pedals 2 are put in storage, creating a huge pile of assorted styles of pedals 2. Different wheelchairs 1 have different spacings of pins. If foot pedals 2 are not used, some people fatigue from holding their feet up during transport. If their feet fall to the floor, there is a serious potential for harm.

Foot pedals 2 are also dangerous when they are in place. If someone is confused, and stands up with the standard foot pedals 2 on the wheelchair 1, the person and the wheelchair 1 are thrown forward. The person is then on the floor, with the wheelchair 1 on top of them. With elevating foot pedals, if the pedals 2 are released and swung to the side of the wheelchair 1, the lifting rods 15 can tear the skin of a bystander's leg. With the foot pedal 2 swung to the side, not only is the brake 12 inoperable, but the self propulsion wheel 8 on the wheelchair 1 is also blocked.

There is a need in the art for a universal foot tray that is easily installed on any design of wheelchair and can be stored on the wheelchair when not in use.

SUMMARY OF THE INVENTION

The universal tray apparatus includes a tray and mounting components. The mounting components preferably include at least one arm that connects to the tray, as well as at least one mounting portion that can be reversibly fastened to an existing portion of a wheelchair. One or more of the arms between the tray and the mounting portion is preferably made such that it can retract and extend, depending upon where the person using the tray apparatus prefers the tray to be in relation to the wheelchair.

Figure 1:
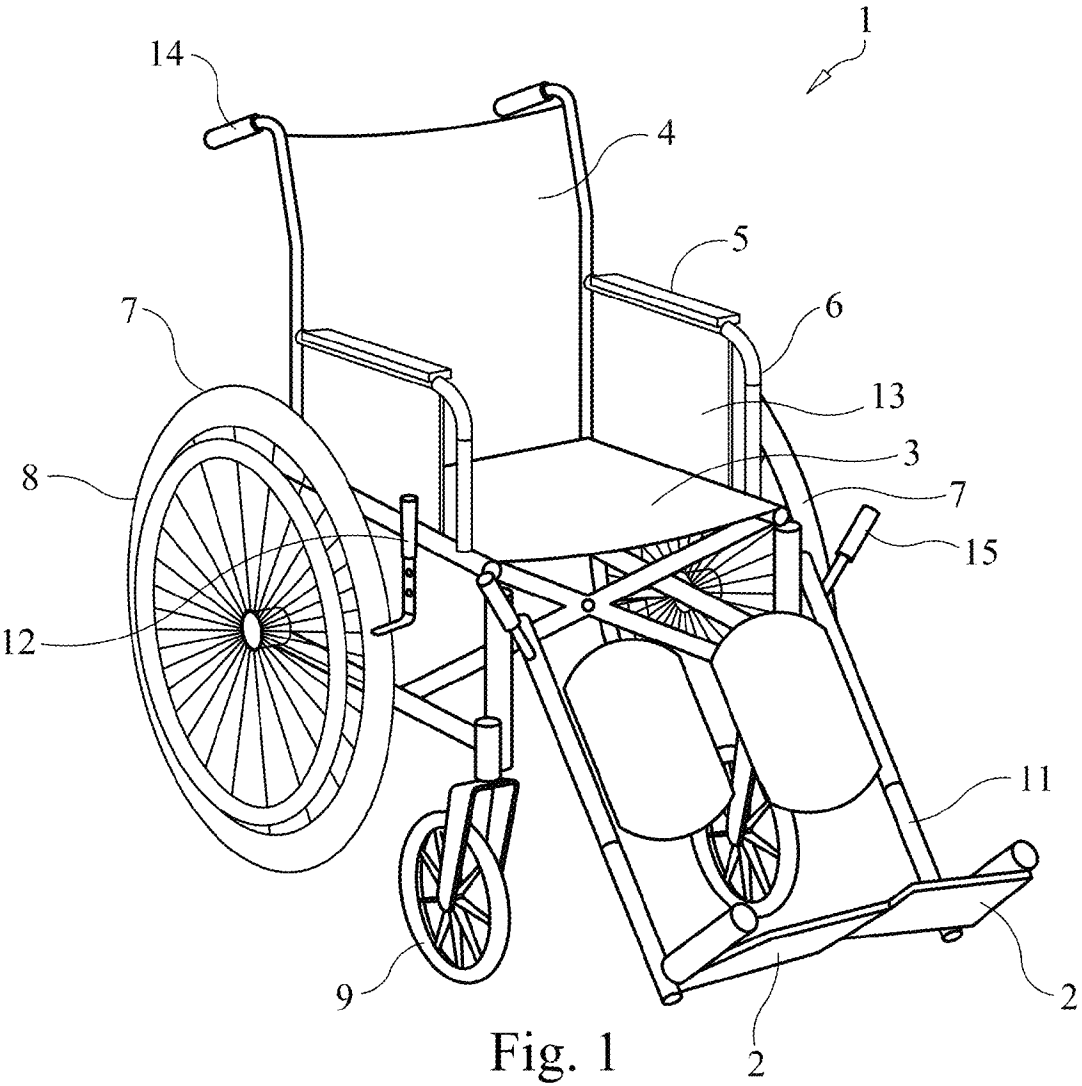
Fig. 1 Prior Art
FIG. 1 shows a wheelchair with prior art foot pedals.

The drawings are not drawn to scale.

DETAILED DESCRIPTION OF THE INVENTION

A universal tray apparatus includes a tray for a wheelchair user to place his feet on either when the wheelchair is stationary or moving. The universal tray apparatus can be extended or retracted to a comfortable location for the person in the wheelchair. The mount portion of the universal tray apparatus is mounted on a portion of the wheelchair so that the universal tray apparatus can extend in and out depending on a person's height. The universal tray apparatus is also designed to fold under the wheelchair when not in use. The universal tray apparatus is easily removable from the wheelchair and preferably lightweight. The universal tray apparatus can preferably be quickly attached or detached from the wheelchair. The tray apparatus can be mounted on the bottom frame found on all wheelchairs. In embodiments with a swing arm, the tray can be adjusted to a person's height.

The entire universal tray device can be easily stored under the wheelchair while it is in the open position. If the user wants to fold the wheelchair, it is simple to remove the tray only, which is lightweight and easy to store elsewhere, while the mounting bracket/system remains on the chair.

The foot trays described herein are preferably lightweight, universal by fitting both feet on one tray, easy to take on and off the wheelchair, adjustable for different leg lengths, adjustable for different makes of chairs, and are easily cleaned.

In addition, the mounting bracket of the tray folds up with the chair when the chair is folded. The tray is easily stored in the empty space under the wheelchair seat.

All of these advantages allow for independent mobility, as well as foot safety when a person becomes fatigued.

The universal tray apparatus includes a tray and mounting components. The mounting components preferably include at least one arm that connects to the tray, as well as at least one mounting portion that can be reversibly fastened to an existing portion of a wheelchair. One or more of the arms between the tray and the mounting portion is preferably made such that it can retract and extend, depending upon where the person using the tray apparatus prefers the tray to be in relation to the wheelchair.

In preferred embodiments, some or all of the mounting components are made of aluminum.

In one preferred embodiment, the tray is 9 inches×14 inches. The number of inches between the casters on wheelchairs is generally constant (11.5 inches between the casters). The distance between the back wheels of chairs and the distance between the front and back wheels of chairs varies. The transport trays described herein include adjustable mounting to accommodate for these variables. In another preferred embodiment, the tray is made of plastic. The top of the tray is preferably made of plastic, and the bottom has casters to effectively turn corners. In one preferred embodiment, the plastic tray is poured or injection molded.

In other preferred embodiments, the tray is made of other materials, including aluminum or other metals. Preferably, the foot tray supports at least 70 pounds. In one preferred embodiment, the tray portion of the universal tray device is supported by the floor and wheels.

In one preferred embodiment, the tray is on two wheels. In one preferred embodiment, the two wheels are 3 inch wheels. In other embodiments, other numbers (for example, one, three, or more than three wheels) and sizes of wheels could be used to make the tray easily transportable along the floor as the wheelchair moves. The number and size of wheels need to provide sufficient stability so if someone stands up, the tray does not pitch forward, dumping the user out of the chair. The number and size of the wheels are also chosen to maximize the freedom of motion that the user experiences while using the tray in combination with the wheelchair. In one preferred embodiment, a double or multiple wheel where each individual wheel works independently, could be used. These wheels permit maximum maneuverability. One example of single, double, and triple wheel with great maneuverability are the Rotacaster® multi-directional wheels (Rotacaster Wheel Limited, Newcastle, Australia).

In some preferred embodiments, there is a steel plate or base on the underside of the tray, which supports the tray and the weight of the user. In other embodiments, no plate is necessary. The plastic trays are preferably designed to be able to hold up to 190 pounds (a 190 pound person standing straight on the tray) without breaking. The tray will flex, but it will not break. The shape of the tray may vary, as long as the tray can comfortably hold both feet of a variety of sizes of people. The tray may have pointed edges, for example edges cut at a right angle, but can alternatively have softer edges on any portion of the tray. In some embodiments, there are softer edges on the back lip of the tray than the front of the tray.

The universal tray embodiments described herein can preferably be used on any standard wheelchair. In other preferred embodiments, the universal tray apparatus can be designed for use on bariatric wheelchairs. In these embodiments, the tray may be wider, and would need more than two wheels in order to support the user of the bariatric wheelchair. The tray apparatus in this embodiment may also preferably include a steel or other metal support on the underside of the tray.

One preferred embodiment for a universal tray apparatus is shown in FIGS. 2 through 7. Most of the components of the universal tray apparatus 110 can be seen in FIGS. 4*a* and 4*b*. More specifically, a tray 120, preferably having wheels or casters 114, is connected to an inner tube or rod 115 with bushings 123. The inner tube 115 is also connected to a swinging tube frame 116. The swinging tube frame 116 is attached to two mounting blocks 118. Knobs or fasteners 122, an end plug 124 and a locking knob 125 (shown in FIG. 4*c*) are also included.

Figure 2A:
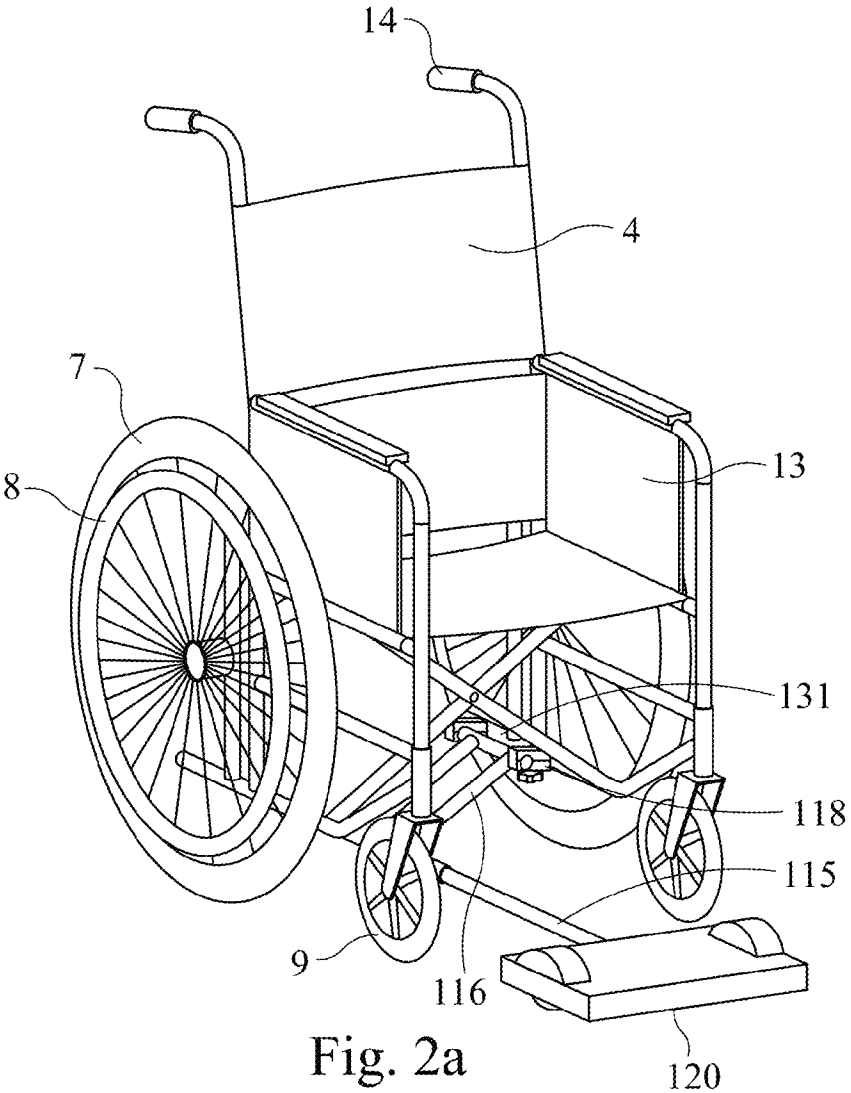
FIG. 2*a* shows a side perspective view of a wheelchair with a universal foot tray in an embodiment of the present invention.
Figure 2C:
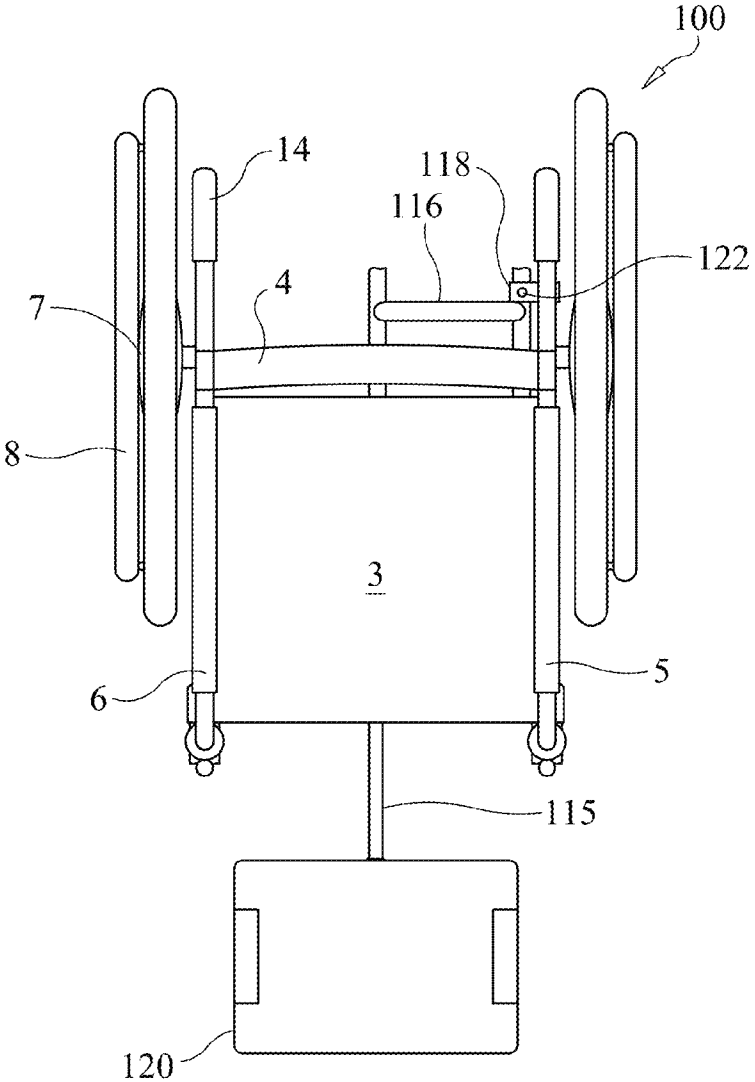
FIG. 2*c* shows a top down view of the wheelchair of FIG. 2*a*.
Figure 2B:
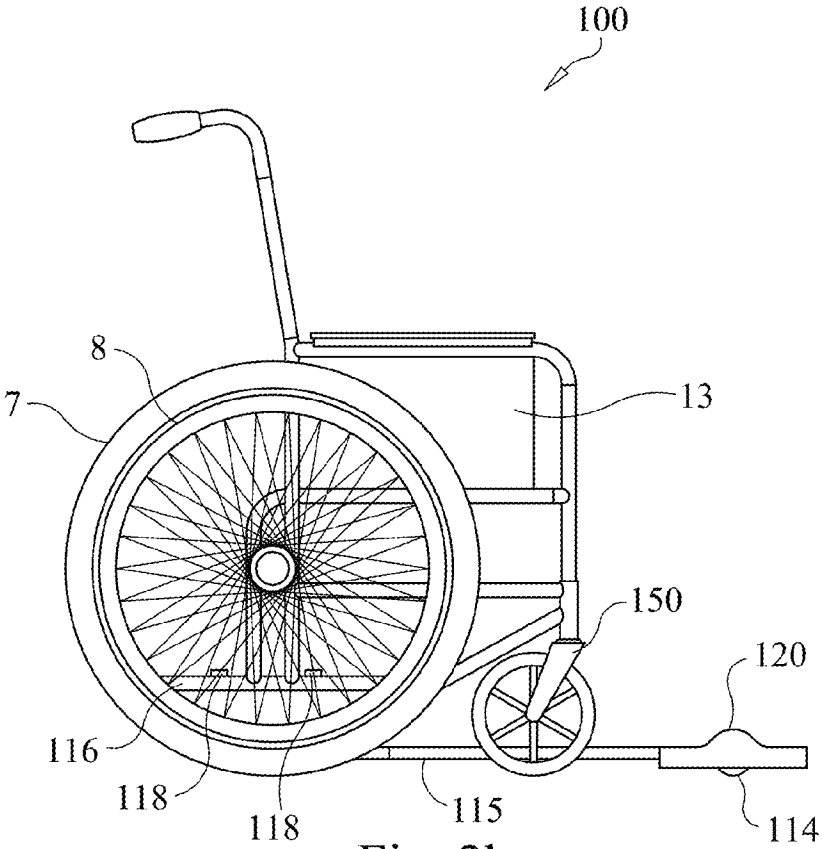
FIG. 2*b* shows a side view of a wheelchair with the universal foot tray of FIG. 2*a*.

FIGS. 2*a* through 2*c* show a wheelchair 100 with the tray apparatus 110 attached to the bottom frame 131 of the wheelchair 100. The wheelchair 100 has many of the same components as discussed with respect to the wheelchair 1 and the same reference numerals are being used herein for those components of the wheelchair 100 not otherwise described. However, the foot pedals 2 and front rigging 11 are replaced with the tray apparatus 110.

Figure 3B:
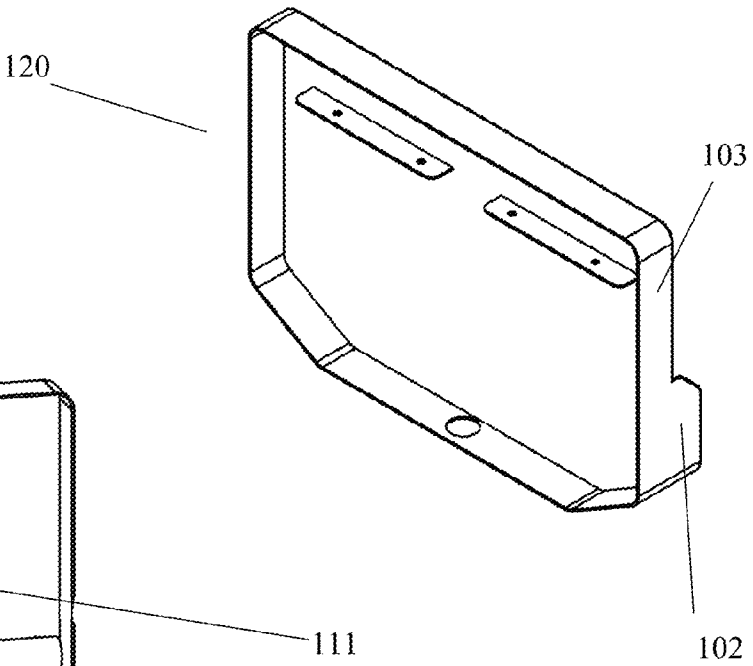
FIG. 3*b* shows another side perspective view of the tray of FIG. 3*a*.
Figure 3A:
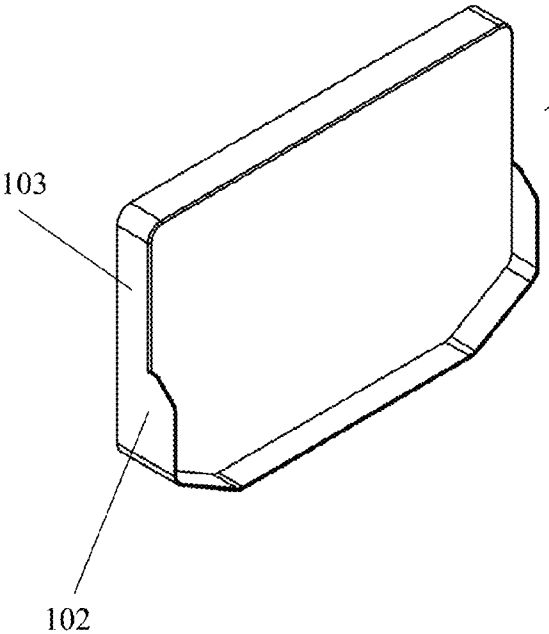
FIG. 3*a* shows a side perspective view of the tray in an embodiment of the present invention.

The tray apparatus 110 and its individual components are shown in FIGS. 3*a* through 3*c* and 4*a* through 4*g*. FIGS. 3*a* and 3*b* show perspective top and bottom views of the tray 120, respectively. Note that, while the tray 120 has a particular six sided shape in these figures, the tray 120 may be of any shape that permits the comfortable placement of a wheelchair user's feet on the tray without impeding the movement of the wheelchair 100. Some tray 120 shapes include square, rectangular, oval, or round trays 120. While a lip 102 is preferred, it is not required.

In one preferred embodiment, the tray is preferably approximately 14 inches long and 9.5 inches wide. In another preferred embodiment, the tray is preferably approximately 12.5 inches long and 9.5 inches wide. Some preferred dimensions for the particular shaped tray 120 in FIGS. 3*a* through 3*c* also include the angled portions 101 of the tray 120 on either side being preferably each approximately 2.5 inches wide and cut at an approximately 30 degree angle. The tray is preferably 1.3 inches high in its narrow portion 103 and 2.2 inches high on its elevated edge or lip 102, which are approximately 4.75 long (from its highest to where it meets the narrow portion 103).

Figure 3C:
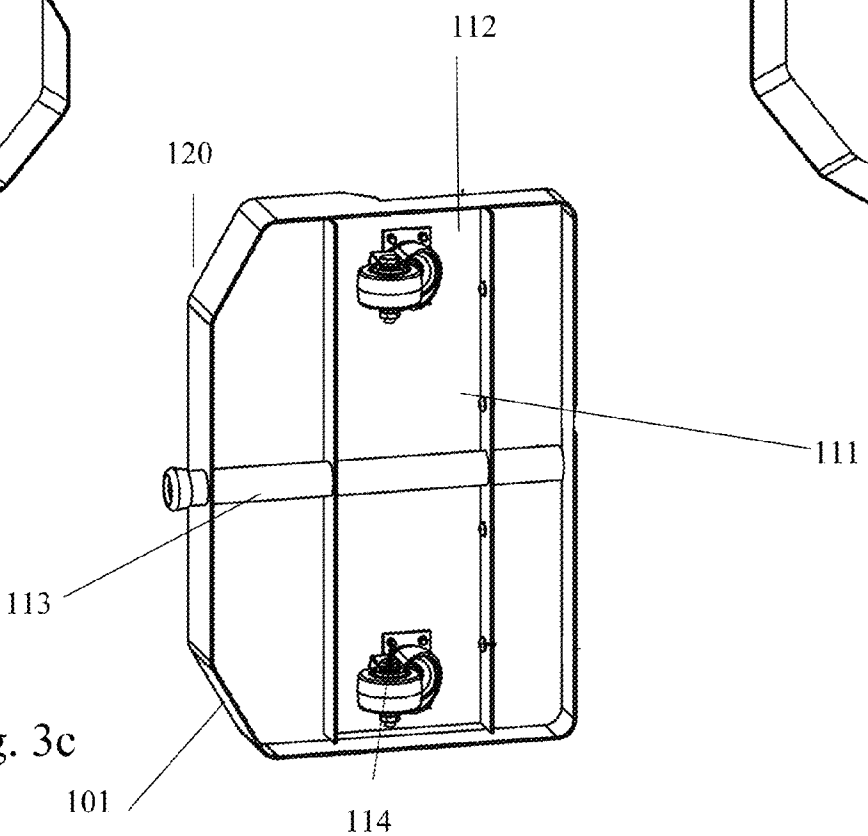
FIG. 3*c* shows a bottom view of the tray of FIG. 3*a* with wheels.
Figure 3D:
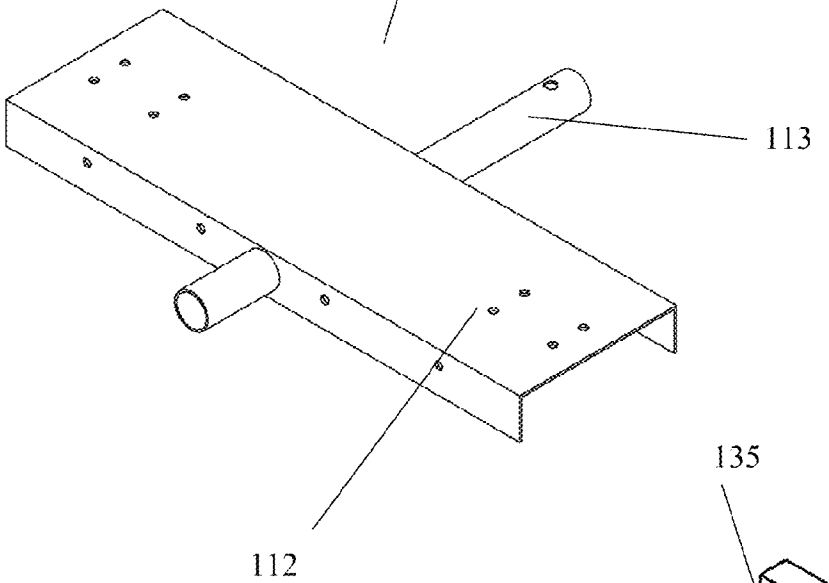
FIG. 3*d* shows the base and rod of the tray portion of the tray apparatus in embodiments with a base.
Figure 4C:
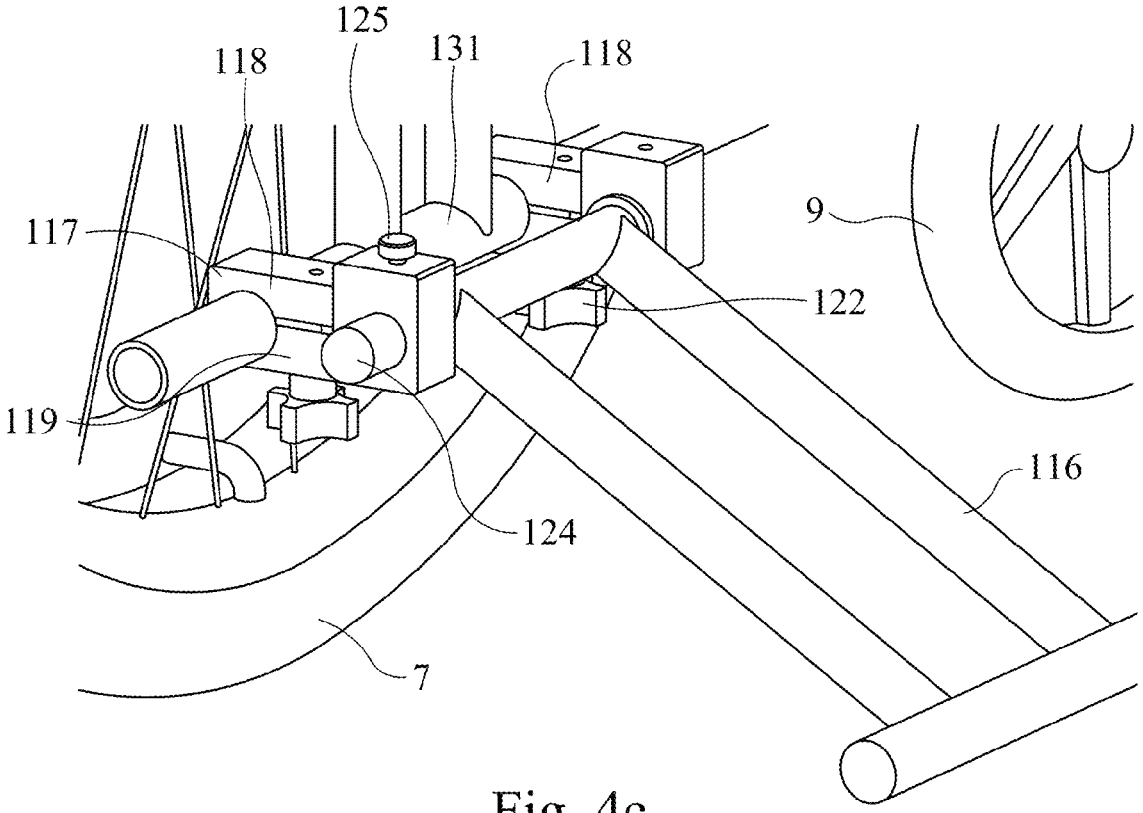
FIG. 4*c* shows the mounting components attached to a wheelchair.
Figure 4F:
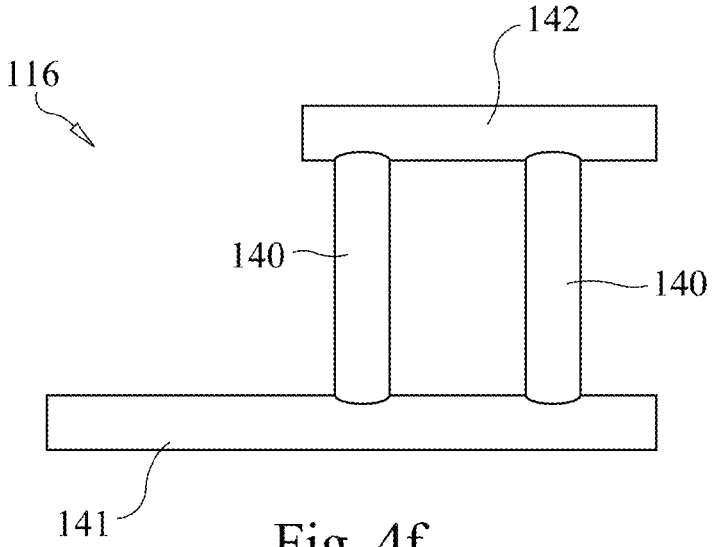
FIG. 4*f* shows the swinging tube frame of the tray apparatus of FIG. 4*a*.
Figure 4G:
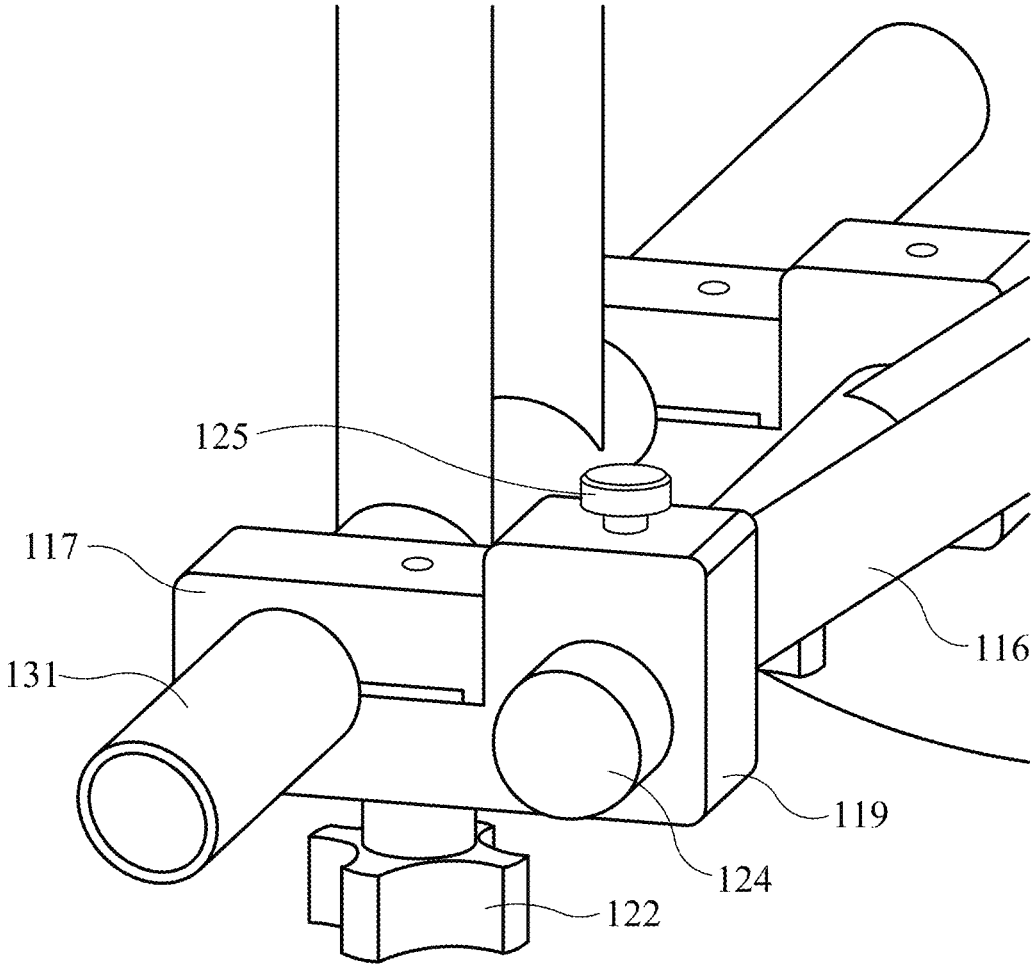
FIG. 4*g* shows a close up view of one of the mounting clamps and a knob of the mounting portion of the tray apparatus.

As shown in FIG. 3*c* and FIG. 3*d*, on the underside of the tray 120, there is preferably a base 112 and a rod or tube 113. In some preferred embodiments, the base 112 and/or the rod 113 are made of steel, aluminum, or another sturdy metal, to add strength to the tray 120. While the base 112 is shown in the figures, in other preferred embodiments, the base 112 is not required as part of the tray 120. Since the tray 120 is made of sturdy plastic, it does not require a base 112 for strength. The rod 113 is permanently affixed directly to the bottom of the tray 120 in embodiments without a base 112. Wheels, or casters, 114 are preferably attached to the base 112. In embodiments without a base 112, the wheels 114 are permanently fastened or otherwise attached directly to the underside of the tray 120. While two wheels 114 are shown in the figures, any number of wheels 114 that permit smooth movement of the tray 120 across the floor could be used. The wheels or casters 114 preferably swivel and turn 360°.

In one preferred embodiment, the rod 113 preferably fits within a hole 111 centered lengthwise on the tray 120. In one preferred embodiment, the rod has a 0.777 inch diameter and the hole 111 in the tray 120 has a 0.875 inch diameter. In embodiments with a base 112, the rod 113 also fits through holes 111 in the base 112.

As shown in FIGS. 4*a* through 4*g*, the tray apparatus 110 also includes mounting components that permit a reversible connection between the tray 120 of the tray apparatus 110 and a wheelchair 100. An inner tube 115 is received by the rod 113 to connect the tray 120 the rest of the mounting portion of the apparatus 110. The inner tube 115 fits into the rod 113 and also into a swinging tube frame 116. In alternative embodiments, the inner tube 115 could have a wider diameter than either the rod 113 or the swinging tube frame 116, such that the swinging tube frame 116 and/or the rod 113 fit inside the ends of the inner tube 115. In one preferred embodiment, the inner tube has a 0.652 inch inner diameter and a 0.750 inch outer diameter. However, the inner tube 115 can be any diameter that permits it to fit into the rod 113 of the tray 120 and the swinging tube frame 116. In one preferred embodiment, the inner tube is approximately 23.25 inches long.

Figure 5B:
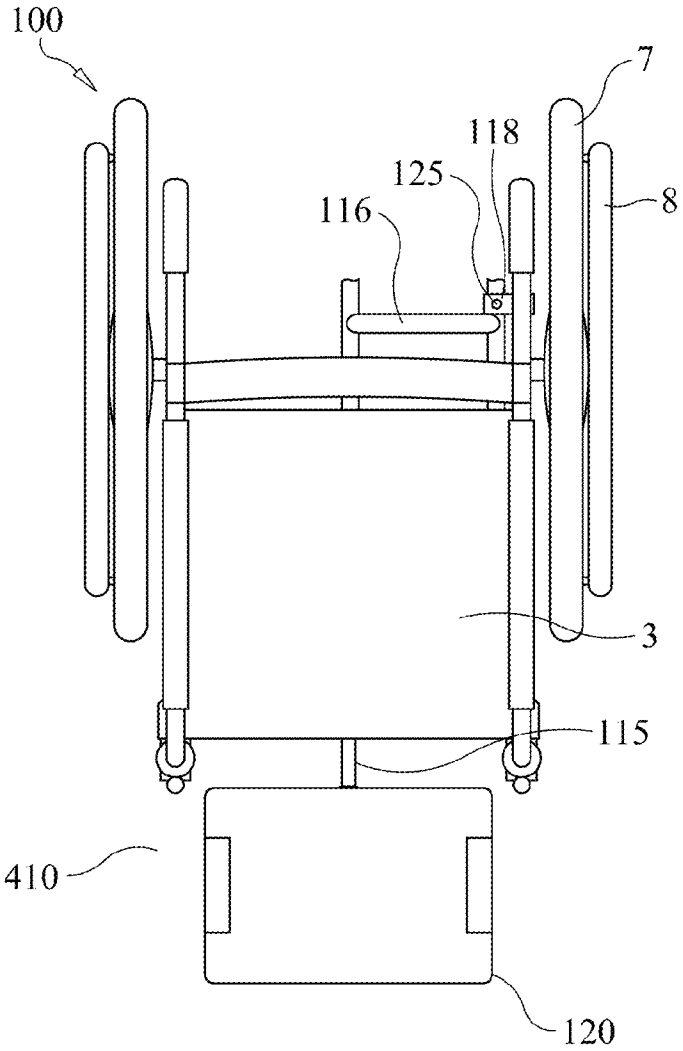
FIG. 5*b* shows a top down view of the wheelchair of FIG. 4*a* in a less extended position.
Figure 5A:
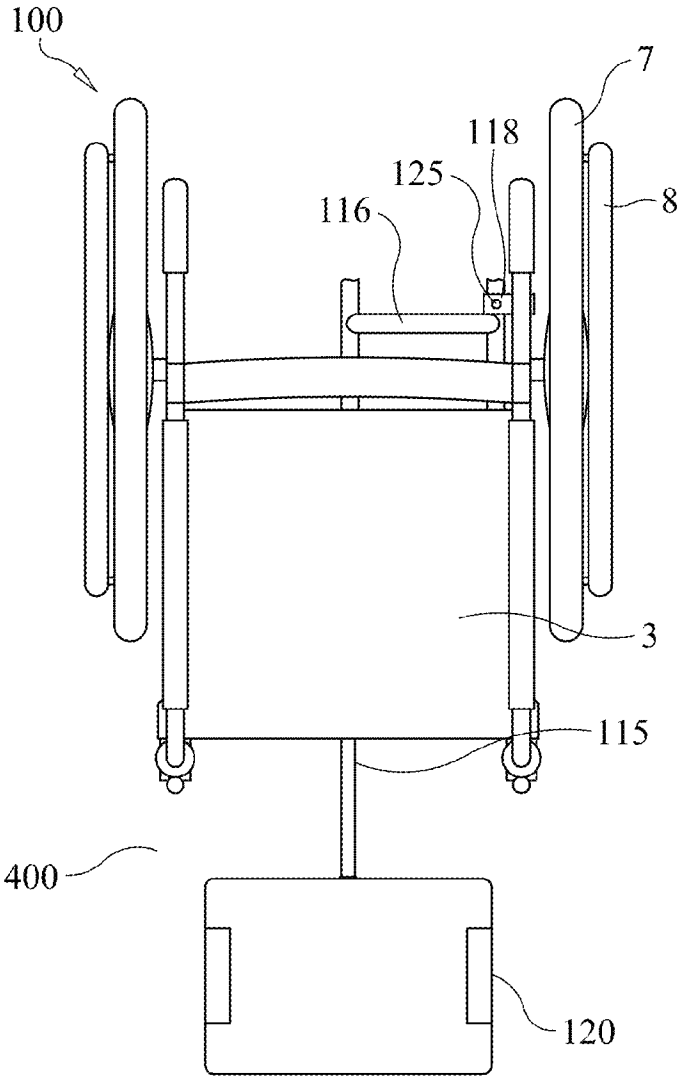
FIG. 5*a* shows a top down view of a wheelchair with the tray in an extended position.

Tube bushings or connectors 123 connect the rod 113 of the tray 120 to the inner tube 115, as well as connecting the inner tube 115 to the swinging tube frame 116. The swinging tube frame permits movement of the tray apparatus 110. The inner tube 115 and the rod 113 also permit the tray apparatus 110 to extend and retract, as shown in FIGS. 5*a* and 5*b*. The inner tube 115 slides in and out of the rod 113 for adjustability. In some preferred embodiments, a spring plunger or button can be used in combinations with holes to change the length of the inner tube 115. The tube diameter of the swinging tube frame 116 is preferably large enough to accommodate the inner tube 115. In one preferred embodiment, where the inner tube has an approximately ⅞ inch diameter, the swinging tube frame has an approximately one inch diameter.

The swinging tube frame 116 preferably includes two sets of parallel arms 140, 141, 142. The longer 141 of the two parallel arms 141, 142 connects to the inner tube 115. The other two arms or braces 140 are the same length as each other and perpendicularly extend from the end of long arm 141 opposite the end that attaches to the inner tube 115. The second arm 142 runs perpendicular to the arms 140 on the end of the arms 140 opposite the long arm 141. The four arms 140, 141, 142 of the swinging tube frame 116 make a flag or P shape.

Figure 4A:
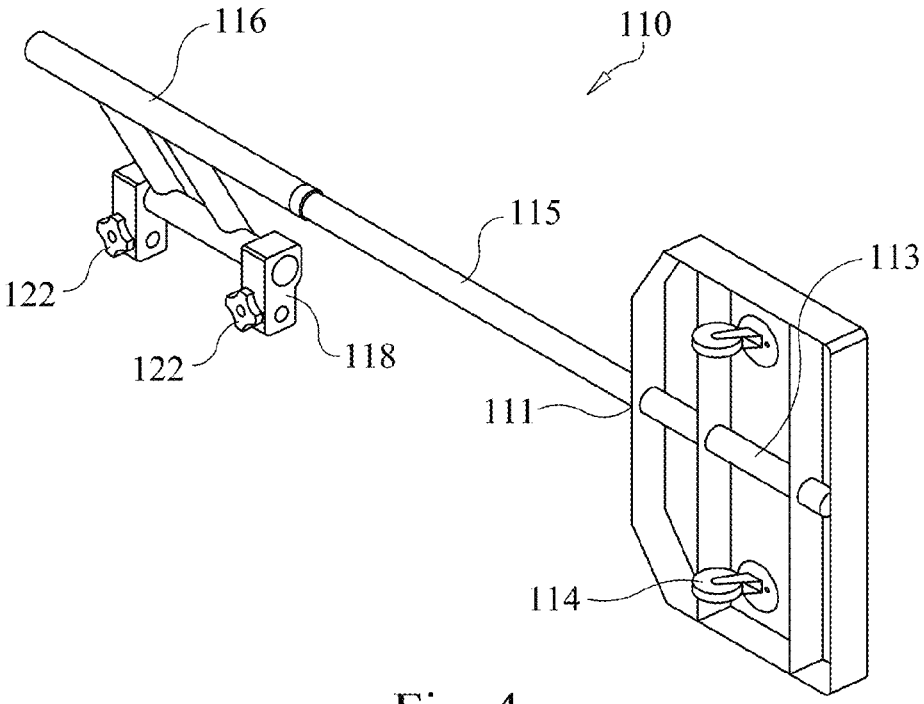
FIG. 4*a* shows the tray apparatus, including the tray and its mounting components.
Figure 4B:
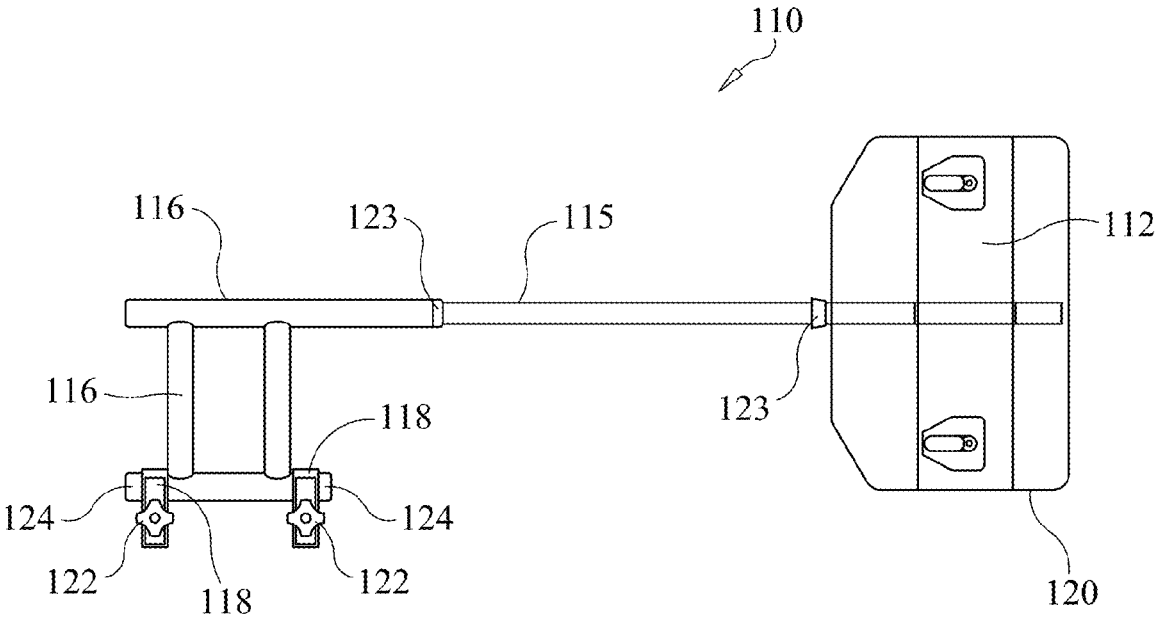
FIG. 4*b* shows a side perspective view of the tray and its mounting components.
Figure 4E:
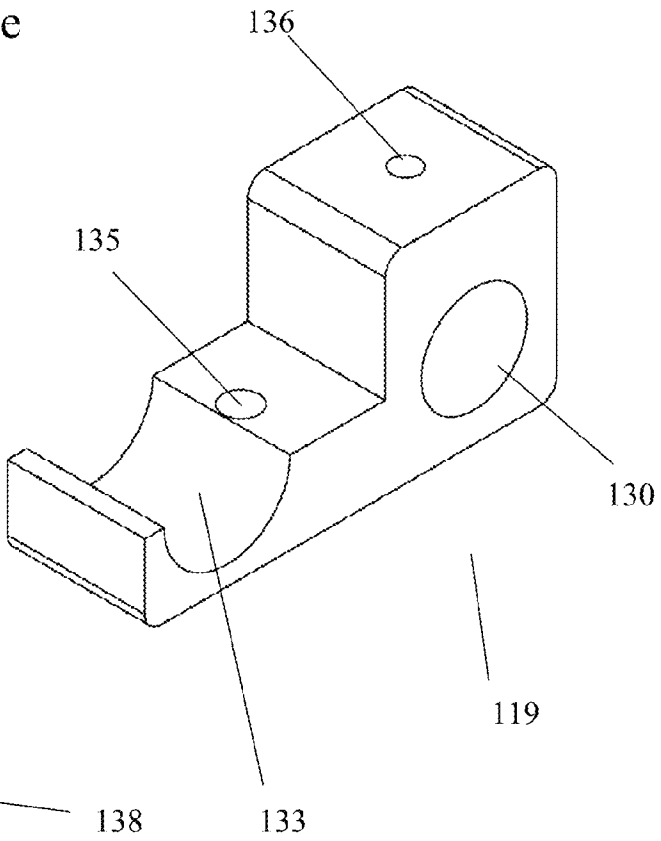
FIG. 4*e* shows a second part of the mounting clamp of the tray apparatus.
Figure 4D:
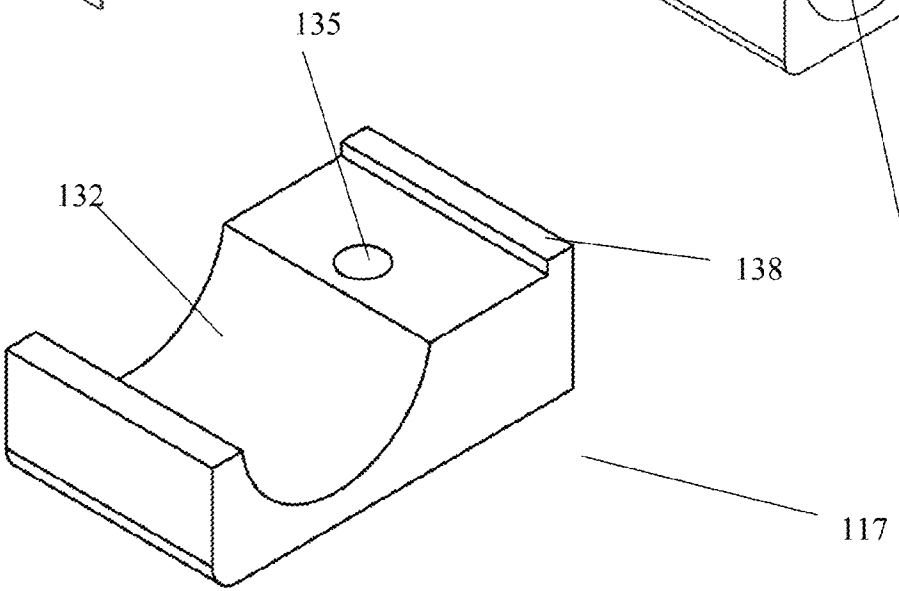
FIG. 4*d* shows one part of the mounting clamp of the tray apparatus.

The short arm 142 of the swinging tube frame 116 fits into two mounting clamps 118, each mounting clamp 118 formed by two parts 117 and 119, shown in FIGS. 4*d* and 4*e*. Each of the larger mounting clamp parts 119 includes a hole 130 through which the swinging tube frame 116 is placed. The swinging tube frame is preferably permanently connected to the larger mounting clamp part 119 through the hole 130. The mounting clamp part 119 also includes a channel 133 that mates with a corresponding channel 132 in the mounting clamp part 117 to hold the mounting clamp 118 and the tray apparatus 110 in place on the wheelchair bar 131. An end plug 124 is preferably located at the end of the swinging tube frame 116, to hold the mounting clamps 118 on the swinging tube frame 116. While two mounting clamps 118 are shown in the figures, one mounting clamp 118 or more than two mounting clamps 118 could alternatively be used to contact the tray apparatus 110 to the wheelchair bar 131.

Some preferred dimensions for the mounting clamp parts 117 and 119 include a total height of approximately 1.500 inches for part 119 at its highest point. The height of part 119 at its lower portion is preferably approximately 0.600 inches. The diameter of the hole for the swinging tube frame 116 is preferably approximately 0.770 inches. The total height of part 117, including the lip 138, is preferably approximately 0.600. The height of the portion without the lip 138 is preferably approximately 0.540 inches. In embodiments with a lip 138, the lip 138 helps lock the part 117 to the part 119, to effectively attach the parts 117 and 119 to the wheelchair 100. The lip 138 aligns the two halves 117 and 119 of the mounting clamp 118 to one another and allows the mounting clamp 118 to go completely around the rod of the wheelchair 100. In one preferred embodiment, the width of parts 117 and 119 are preferably approximately 1.00 inch. Parts 117 and 119 are also preferably approximately 1.5 inches high and 3 inches long in one preferred embodiment.

Although the mounting clamps 118 and their parts 117 and 119 are shown as specific shapes in the figures, any shape that permits the mounting clamps 118 to hold the swinging tube frame 116 and to reversibly fasten to a bar 131 of a wheelchair 100 could be used.

At least one knob 122 fastens the two parts 117 and 119 of the mounting clamps 118 to a back rod 131 of the wheelchair 100. The knob 122 fits through the mating holes 135 of the two clamping parts 117 and 119. In one preferred embodiment, the knob 122 is a four prong plastic knob 122. A second knob 125, shown in FIG. 4*g*, locks the tray apparatus 110 in place when it is in storage mode when placed through the hole 136 in mounting clamp part 119. The knob 125 needs to be lifted (pulled) to release the tray apparatus 110 and convert it from storage mode to being able to let the tray 120 ride on the floor.

FIGS. 5*a* and 5*b* show a top down view of the tray 120 attached to the wheelchair 100 in an extended 400 and retracted 410 position, respectively. Expansion and retraction of the tray 120 is preferably accomplished by lengthening and shortening the inner tube 115, which moves within the rod 113 and or swinging tube frame 116. The adjustment is made in one embodiment by loosening the bushings 123 to expand or retract the inner tube 115, then tightening the bushings 123 again when the inner tube 115 is at the desired length. In another embodiment, a spring plunger or button on the inner tube 115, and a number of holes on the rod 113 or the swinging tube frame 116, into which the spring plunger fits, are used, so that the inner tube 115 can be adjusted by choosing a hole in the swing tube frame or rod 113 in which the spring plunger is fit to get the desired length of the inner tube 115.

Figure 5D:
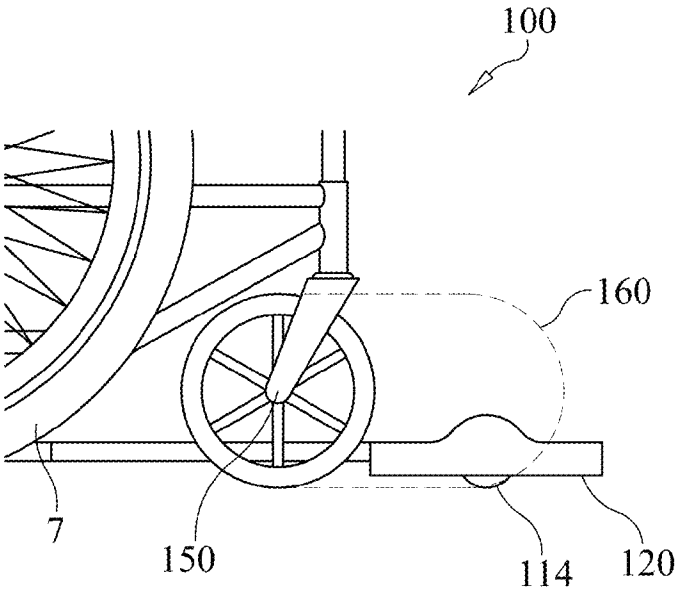
FIG. 5*d* shows another view of the space taken by the casters as they turn.
Figure 5C:
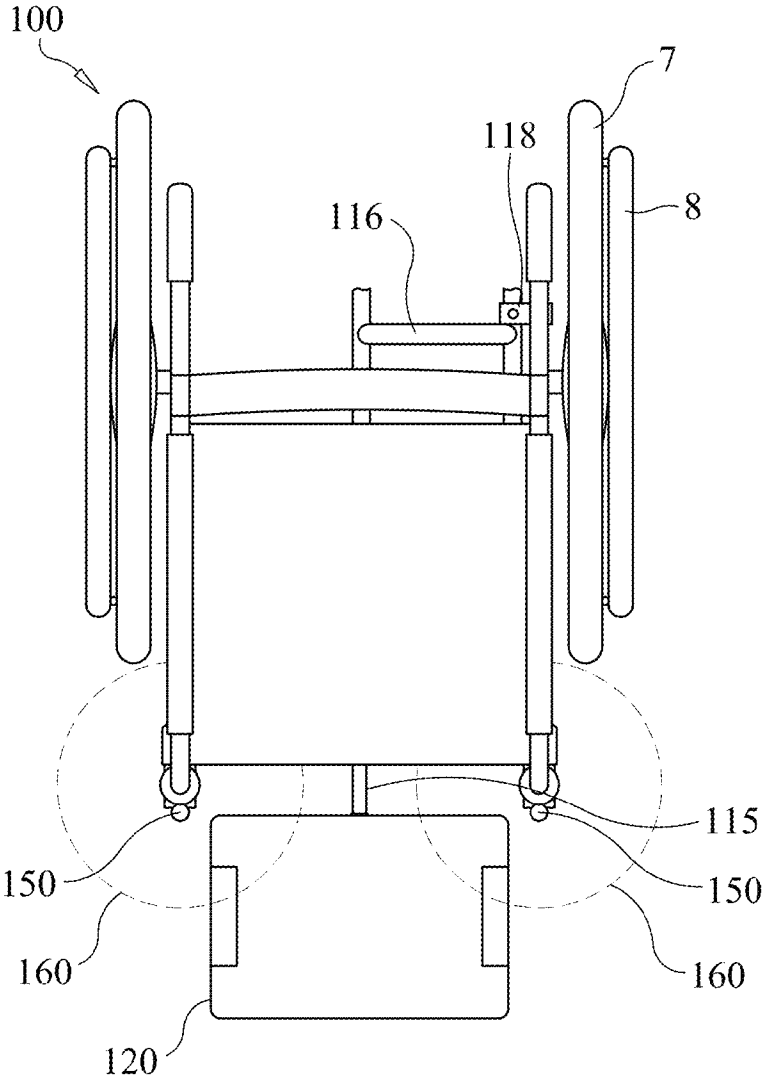
FIG. 5*c* shows the space taken by casters as they turn.

FIGS. 5*c* and 5*d* show the space 160 the casters 150 need to turn. A caster (or castor) is an undriven, single, double, or compound wheel that is designed to be mounted to the bottom of a larger object (the "vehicle") so as to enable that object to be easily moved. They are available in various sizes, and are commonly made of rubber, plastic, nylon, aluminum, or stainless steel. Casters may be fixed to roll along a straight line path, or mounted on a pivot such that the wheel will automatically align itself to the direction of travel.

Figure 6B:
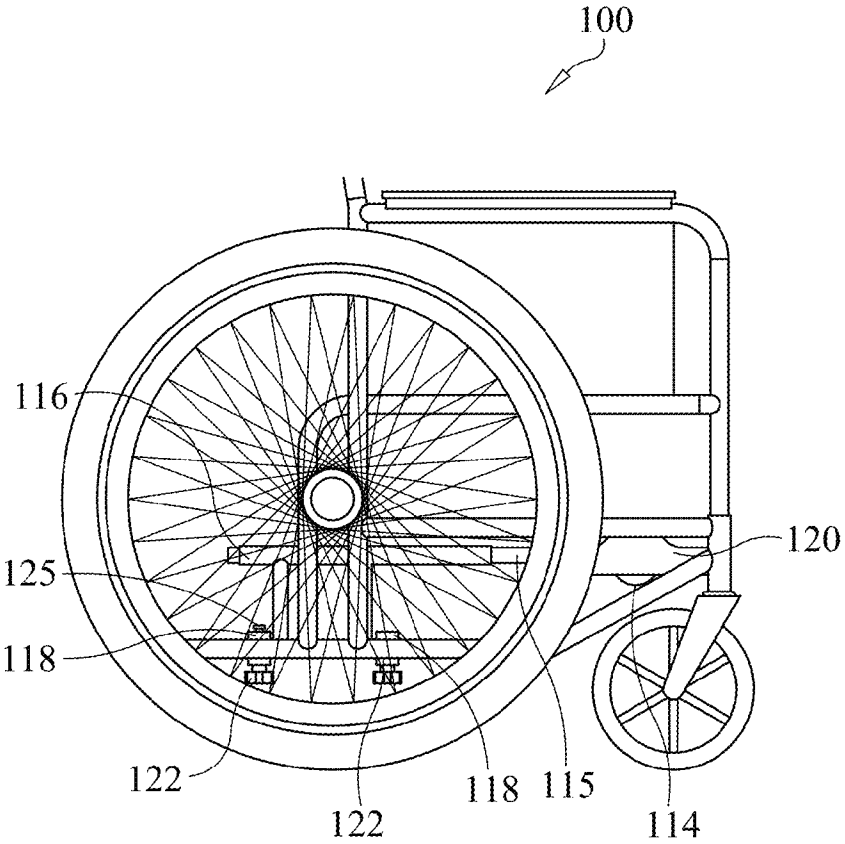
FIG. 6*b* shows a side view of the tray in a storage position with the wheelchair open.
Figure 6A:
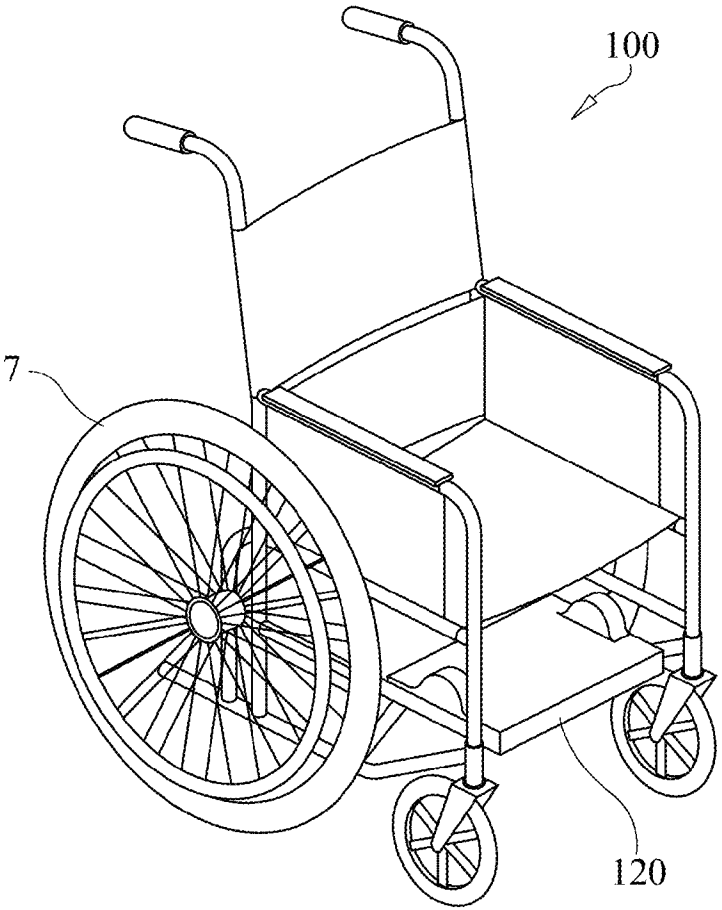
FIG. 6*a* shows a side perspective view of the tray in a storage position with the wheelchair open.
Figure 6C:
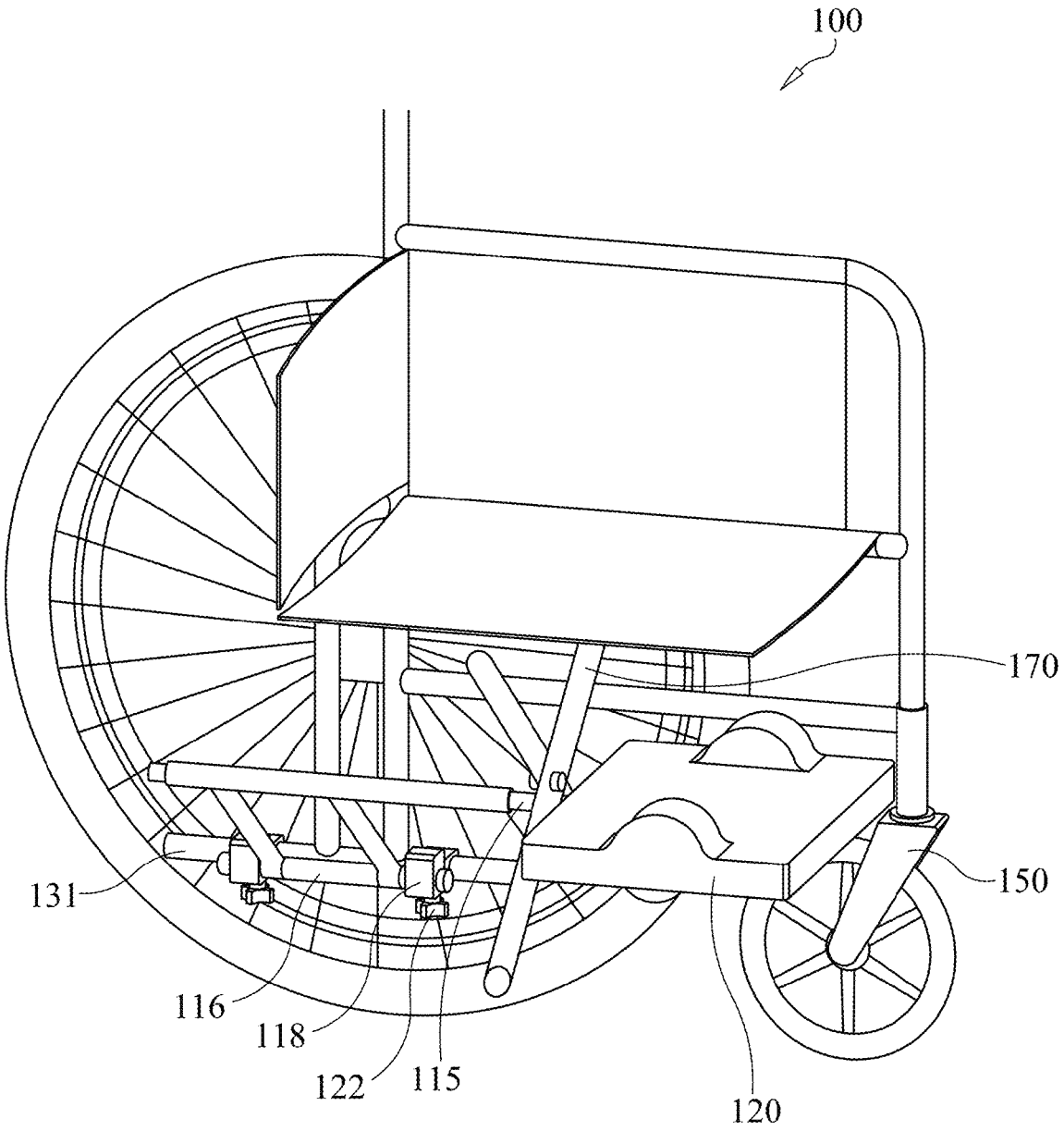
FIG. 6*c* shows another side perspective view of the tray stored with the wheelchair open.
Figure 6D:
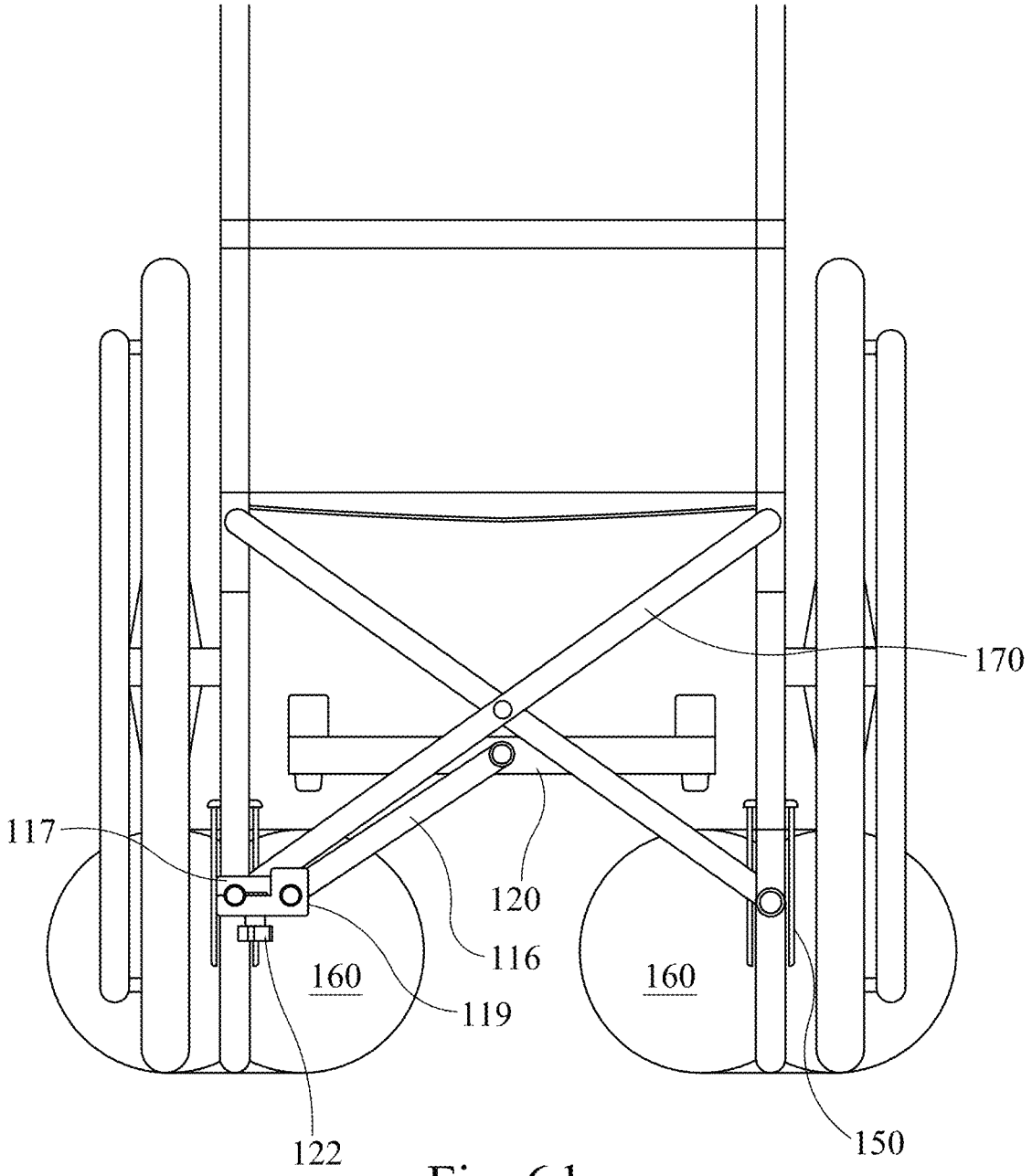
FIG. 6*d* shows a back view of the tray stored with the wheelchair open.

The casters 150 need a lot of space 160 to turn and they will not have full motion if the tray 120 is in close to the wheelchair 100. In one preferred embodiment, the tray 120 has a slight taper so there is less chance of interfering with the casters 150. Retraction of the tray 120 may be limited with small wheelchairs 100 because the tray 120 needs to clear the casters 150 of the wheelchair 100. For taller people using the wheelchair 100, the inner tube 115 can be made longer, especially in smaller model wheelchairs 100. In embodiments with a spring plunger, the spring plunger is pulled up and put in a hole that increases the extension of the inner tube 115 and the tray 120. As shown in FIGS. 6*c* and 6*d*, when stored, the tray 120 is stored above the casters 160 so that it does not interfere with the movement of the casters.

FIGS. 6*a* through 6*d* show the tray stored when the wheelchair is in the open position. FIGS. 6*c* and 6*d* show the tray stored above the casters so they can swing, but the support rod is below the X brace 170 on the back of the wheelchair. The room between the X brace and the front of the chair is what makes the tray preferably just 9 inches front to back.

Figure 7:
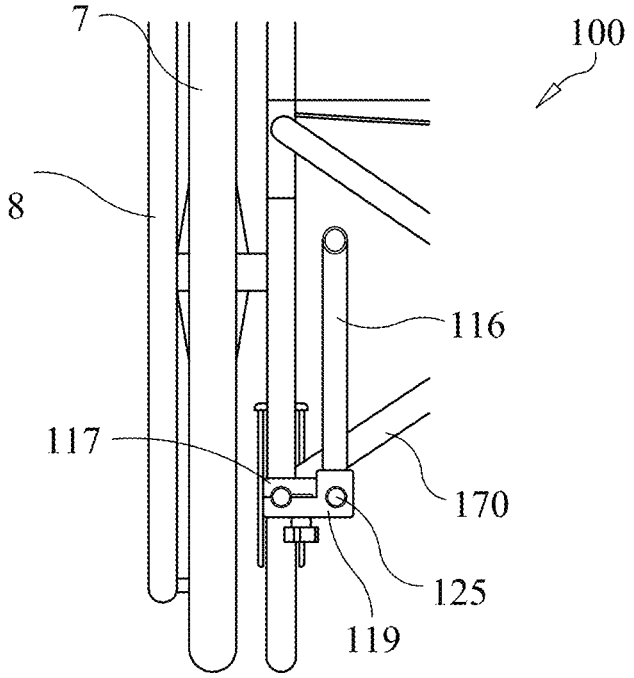
FIG. 7 shows a portion of the wheelchair with the tray portion removed and the wheelchair folded.
Figure 12A:
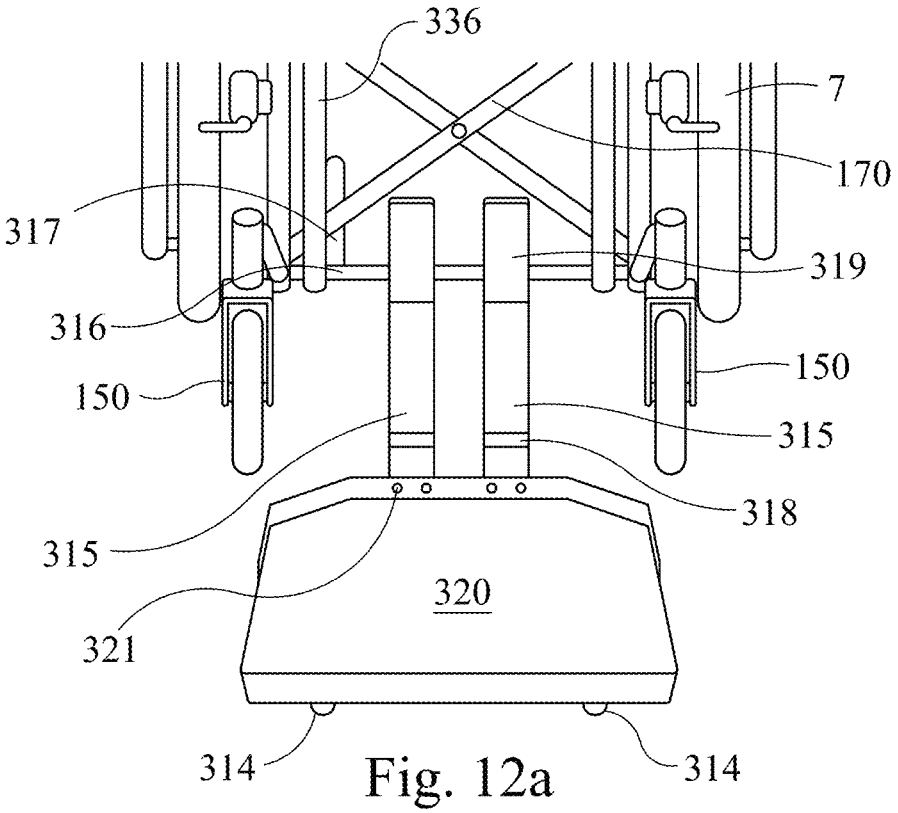
FIG. 12*a* shows a top front view of the universal tray apparatus on the front of a wheelchair.
Figure 8B:
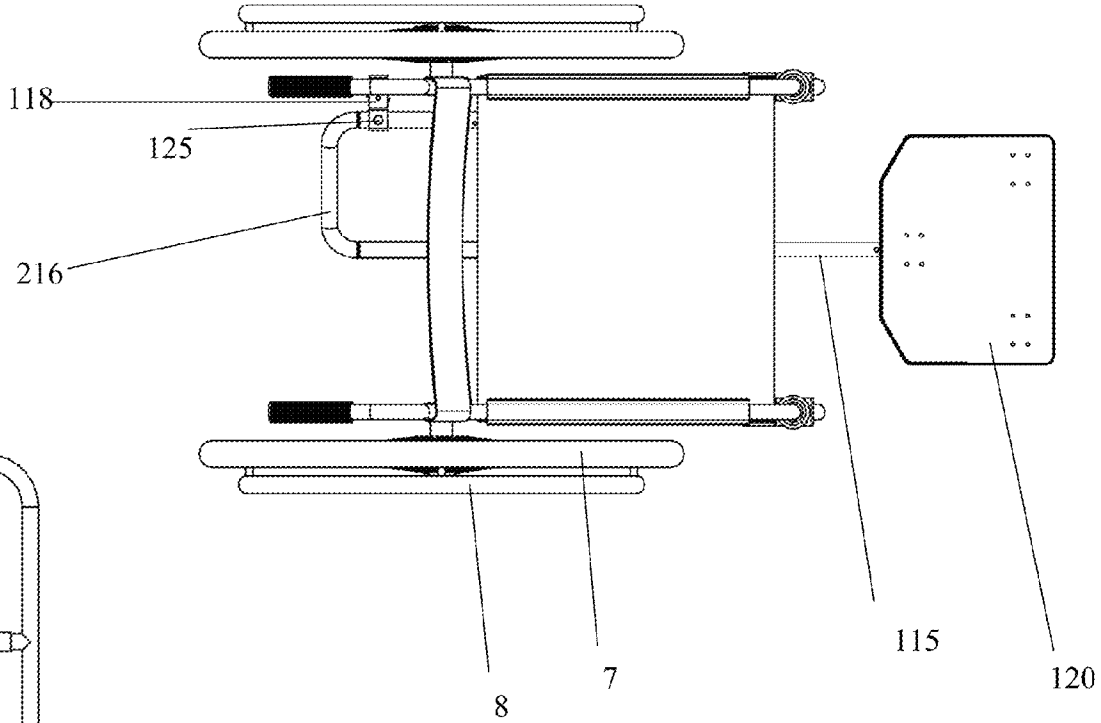
FIG. 8*b* shows a top down view of the wheelchair of FIG. 8*a*.
Figure 8A:
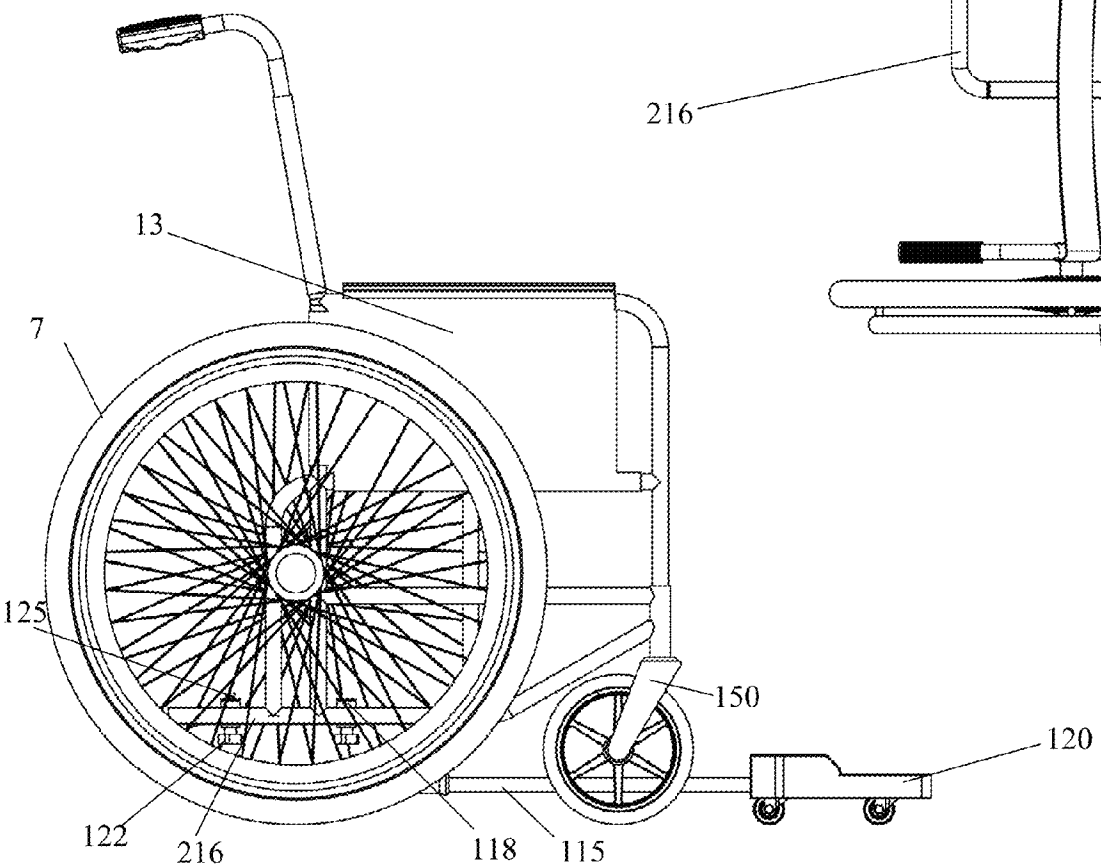
FIG. 8*a* shows an alternative embodiment of a universal tray apparatus with a swinging tube frame attached to a wheelchair.
Figure 9A:
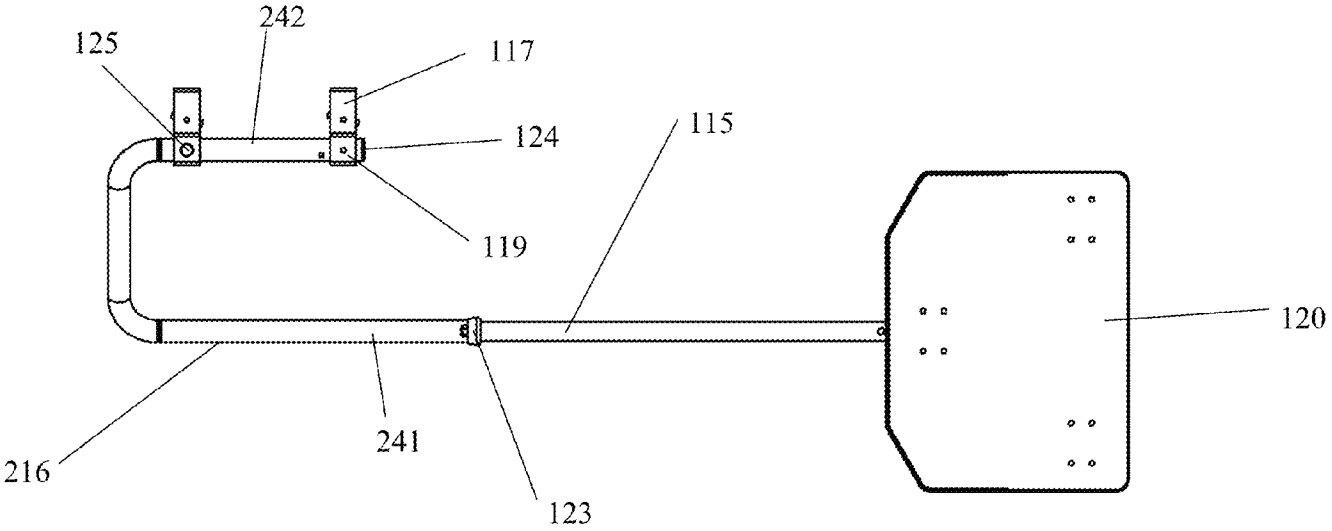
FIG. 9*a* shows a top down view of the universal tray apparatus of FIGS. 8*a* and 8*b*.
Figure 9B:
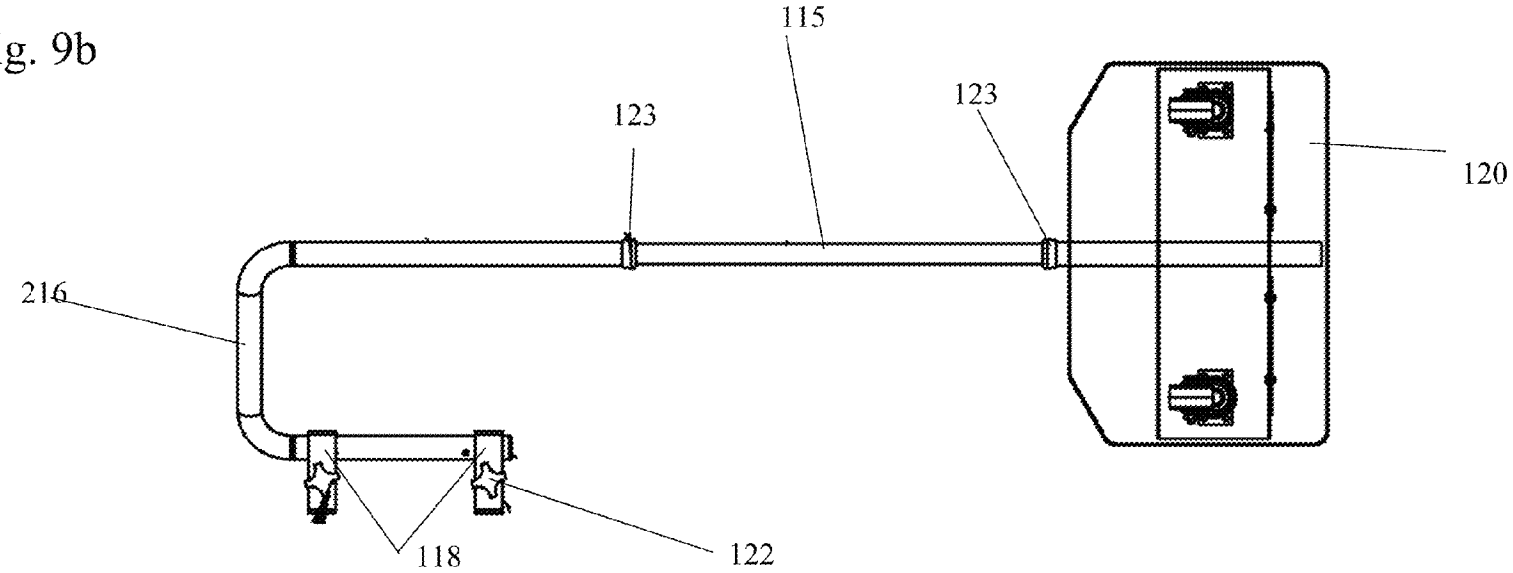
FIG. 9*b* shows a view from the bottom of the universal tray apparatus of FIG. 9*a*.
Figures 9C, 9D:
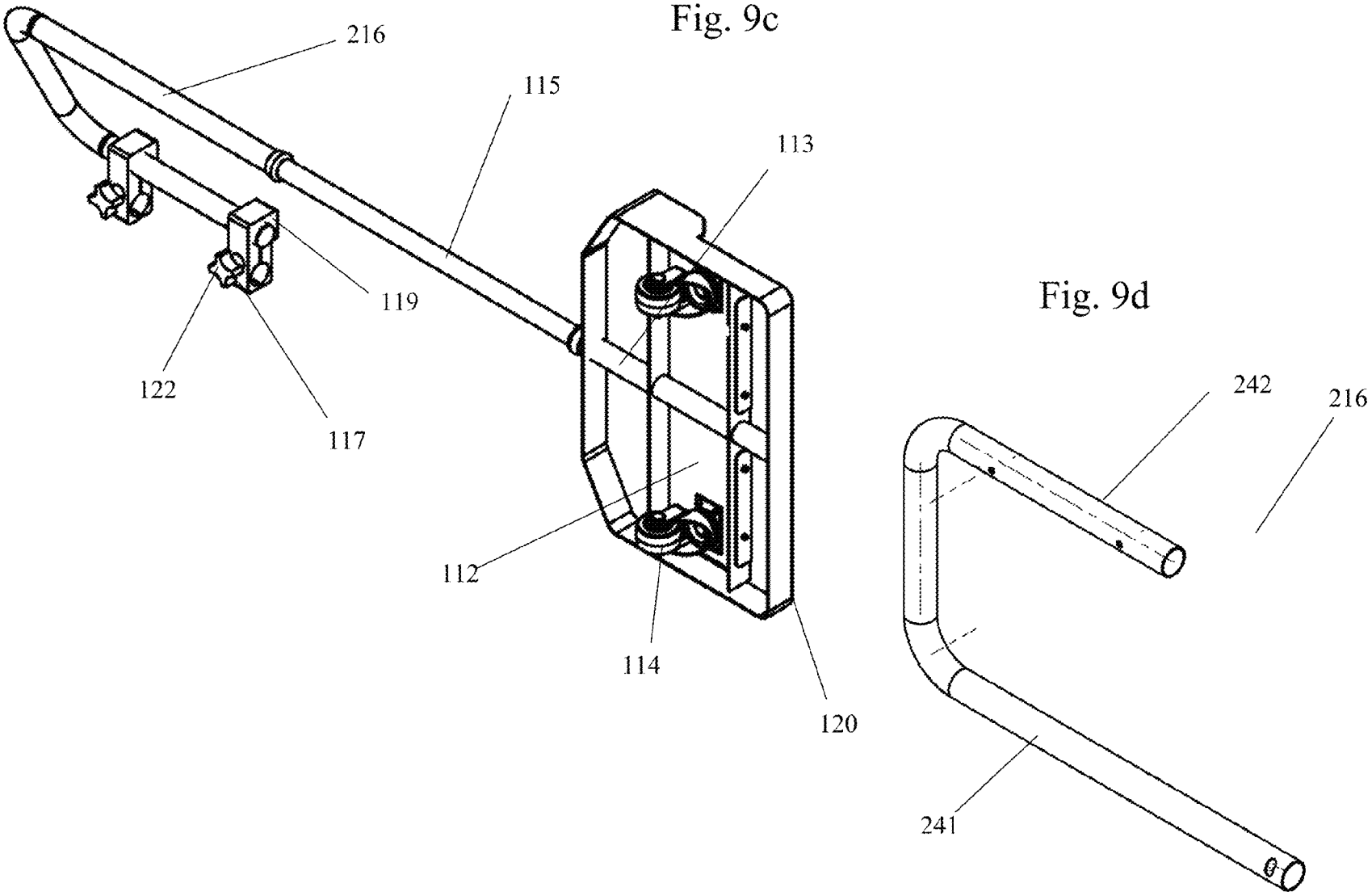
FIG. 9*c* shows a side perspective view of the universal tray apparatus of FIG. 9*a*.
FIG. 9*d* shows a view of the swinging tube frame of the universal tray apparatus of FIG. 9*a*.
Figures 9E, 9F, 9G:
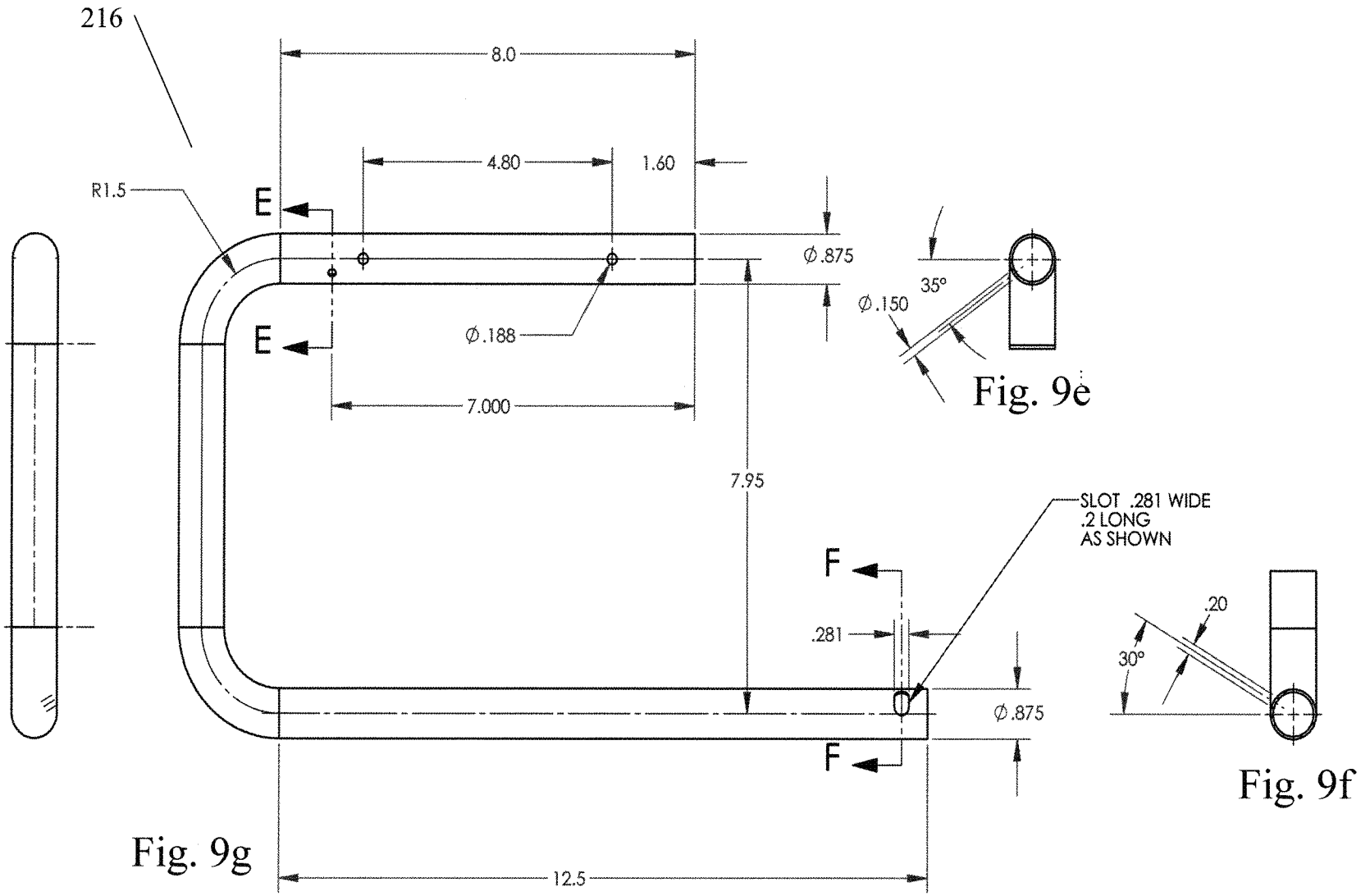
FIG. 9*e* shows a cross-sectional view along lines E-E of FIG. 9*g*.
FIG. 9*f* shows a cross-sectional view along lines F-F of FIG. 9*g*.
FIG. 9*g* shows some preferred dimensions for the swinging tube frame of FIG. 9*a*.

FIG. 7 shows the folded mode, where the tray portion of the universal tray 120 has been removed, and the tray support arm 115 and swing arm 116 have been rotated vertically, as shown in the Figure.

An alternative shape for the swinging tube frame 216 for the universal tray apparatus 110 is shown in FIGS. 8*a* through 9*d*. The universal tray apparatus attaches to the wheelchair in a similar manner as discussed with respect to FIGS. 2 through 7, but the shape of the swinging tube frame 216 is different than the swinging tube frame 116 shown in the previous embodiment. More specifically, instead of a swinging tube frame shape 116 having two parallel braces 140 perpendicular to two parallel rods or tubes 141, 142, the swinging tube frame 216 is J-shaped, with the long side 241 of the J connecting to the inner tube 115 and the shorter side 242 of the J including the mounting clamps 118. In one preferred embodiment, the swinging tube frame 216 the dimensions shown in FIGS. 9*e* through 9*g*.

In preferred embodiments, the inner tube 115, swinging tube frame 116, 216, and the mounting blocks 117, 118, 119 are preferably made of sturdy aluminum, steel, another preferably lightweight metal, or a sturdy plastic material.

The tray 120 must extend past the front wheels of the wheelchair 100 so that the wheelchair 100 can make turns. The swinging tube frame 216 mounts to the wheelchair, while the inner tube 115 makes the adjustments for the person in the wheelchair 100 to that person's leg length. In one preferred embodiment, there is a knob or spring plunger as part of the inner tube 115 that can be lifted up so that it can be moved to alternative holes in the swinging tube frame 116, 216, or the rod 113 to adjust the length of the inner tube 115 and subsequently how far the tray 120 extends from the wheel chair 100. The embodiments shown in FIGS. 2-9 are preferred on older Everest and Jennings wheelchairs.

An alternative embodiment for the universal tray device is shown in FIGS. 10 through 15. In this embodiment, the universal tray apparatus 310 is reversibly connected to a wheelchair 300 using four arms 315, 316, 317, preferably made of aluminum, and a block 330 that attaches to the back of the wheelchair using one or more clamp plates 334.

Figure 10A:
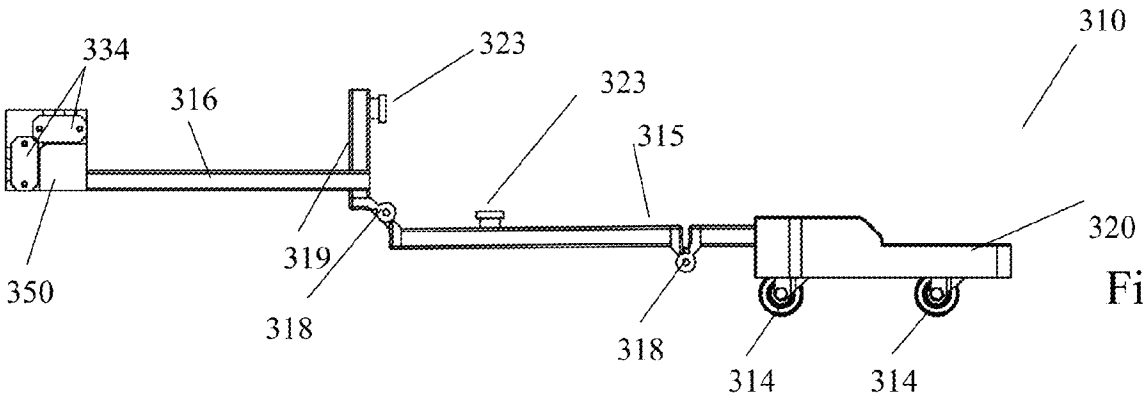
FIG. 10*a* shows a side perspective view of a tray apparatus in an alternative embodiment of the present invention.
Figure 10B:
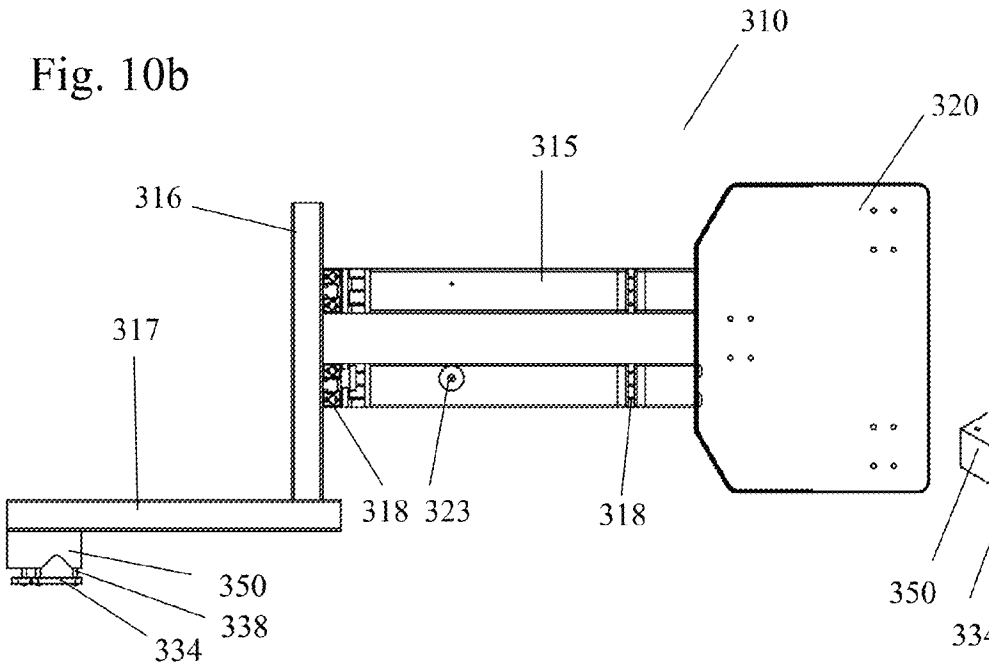
FIG. 10*b* shows a top down view of the tray apparatus of FIG. 10*a*.
Figure 10C:
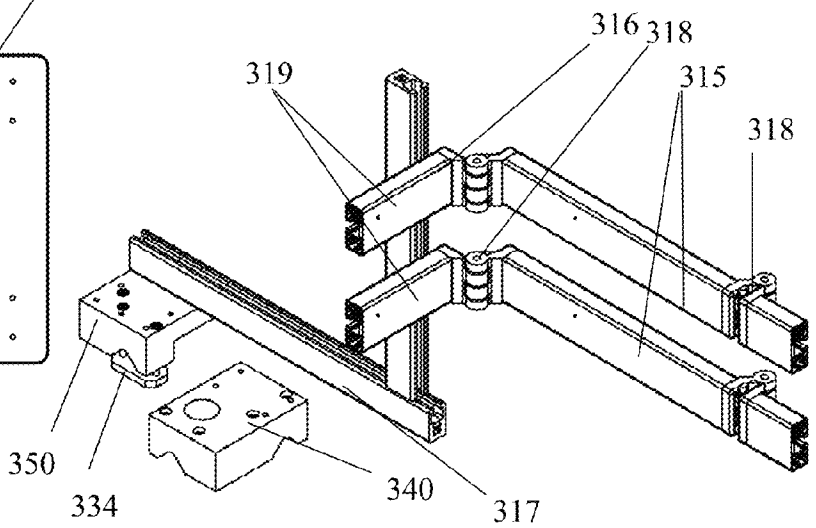
FIG. 10*c* shows a side perspective view of the tray apparatus of FIG. 10*a*, without the tray.

Most of the components of the universal tray apparatus 310 can be seen in FIGS. 10*a* and 10*b*. More specifically, a tray 320, preferably having wheels or casters 314, is connected to two arms 315, which preferably include hinges 318 and a vertical portion 319. A second arm 316 connects to the vertical portion 319 of the arm 315. A third arm 317 connects to a mounting block 340, 350, with two notches 332 and 333 (shown in FIGS. 11*a* through 11*f*). Two clamp plates 334, fasteners 338, and magnets 323 are also preferably included.

The frame of the universal tray apparatus in this embodiment is preferably made of aluminum.

Every wheelchair 300 includes two bars: one horizontal bar 337 and one vertical bar 336, on the back of the wheelchair 300. The diameter of these bars 336 and 337 differ depending on the make and manufacture of the particular wheelchairs 300. In many wheelchairs, these bars 336 and 337 have a one inch angle from front to back.

In this embodiment, a mounting block 330 attaches to the back of the wheelchair 300. The mounting block 330 preferably has two notches 331 and 332. These two notches 331 fit the vertical bar 336 and the horizontal bar 337 of the wheelchair 300, respectively. The notches 331 and 332 are each able accommodate a lot of different diameters of wheelchair bars 336 and 337.

At least one clamp plate 334 is preferably used to reversibly attach the universal tray apparatus 310 to the wheelchair 300. The clamp plate 334 is attached to the mounting block 330 using at least one fastener. In one embodiment, there is a first clamp plate 334 that is placed horizontally on an opposite side of the horizontal bar 337 from the mounting block 330, to sandwich and hold the horizontal bar 337 in place between the mounting block 330 and the clamp plate 334. A second clamp plate 334 is placed vertically on an opposite side of the vertical bar 336 from the mounting block 330, to sandwich and hold the vertical bar 336 in place between the mounting block 330 and the clamp plate 334.

Figure 10E:
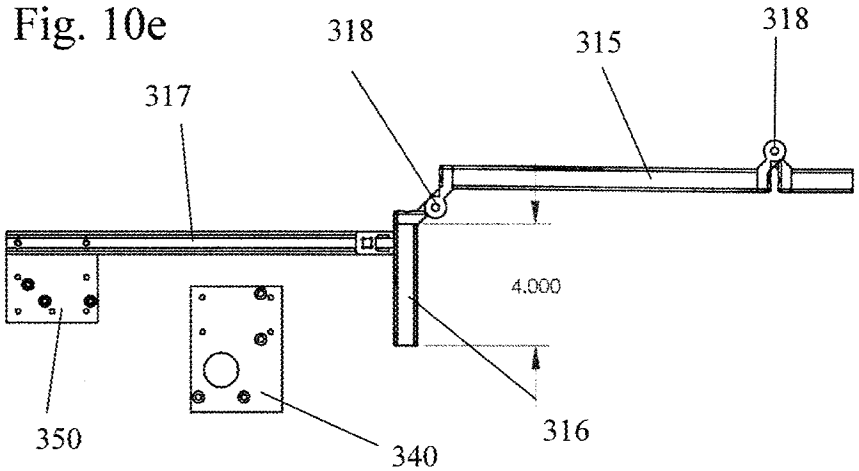
FIG. 10*e* shows a top down view of the tray apparatus of FIG. 10*a*, without the tray.
Figure 10F:
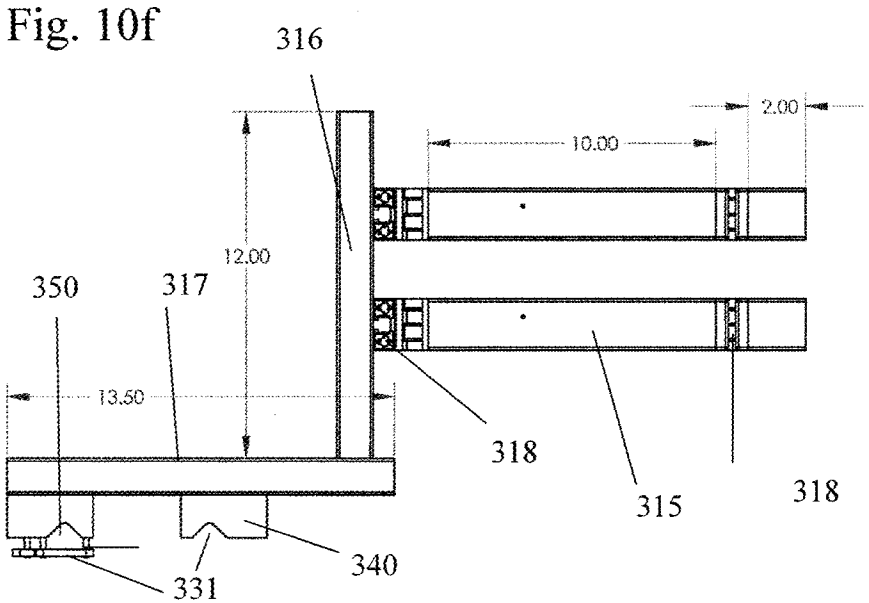
FIG. 10*f* shows another view of the tray apparatus of FIG. 10*a*, without the tray.
Figure 10D:
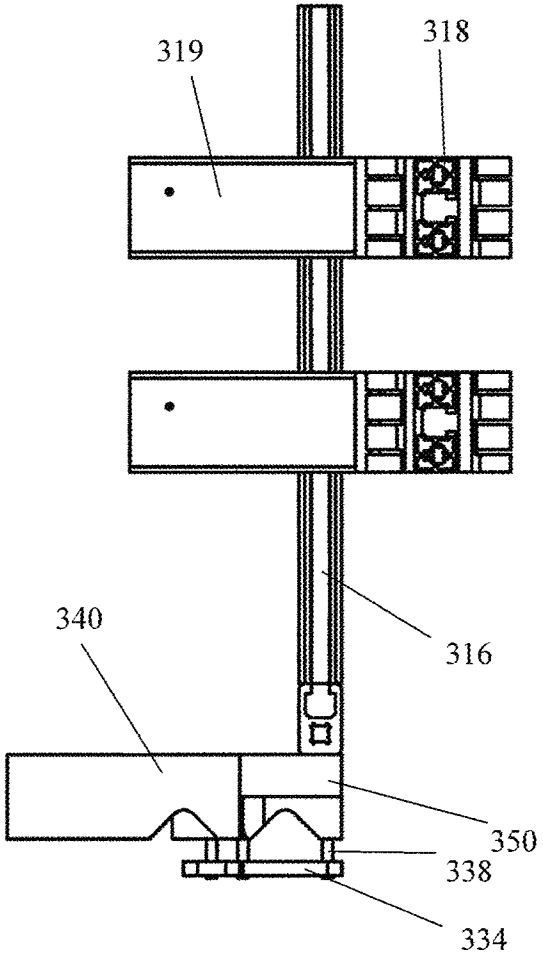
FIG. 10*d* shows another view of the tray apparatus of FIG. 10*a*, without the tray.

Some preferred dimensions for the device are found in FIGS. 10*e* and 10*f*.

Two examples 340, 350 of a mounting block 330 are shown in FIGS. 11*a* through 11*f*. The mounting block 350 fits most wheelchairs. However, the mounting block 340 is more universal, because it can also fit on certain wheelchairs that can raise the axle on the wheelchair (for example, the Invacare® Tracer® wheelchair). Since the mounting block 340 is longer, the extended block 340 can go up when the axle of the wheelchair goes up.

Figure 11B:
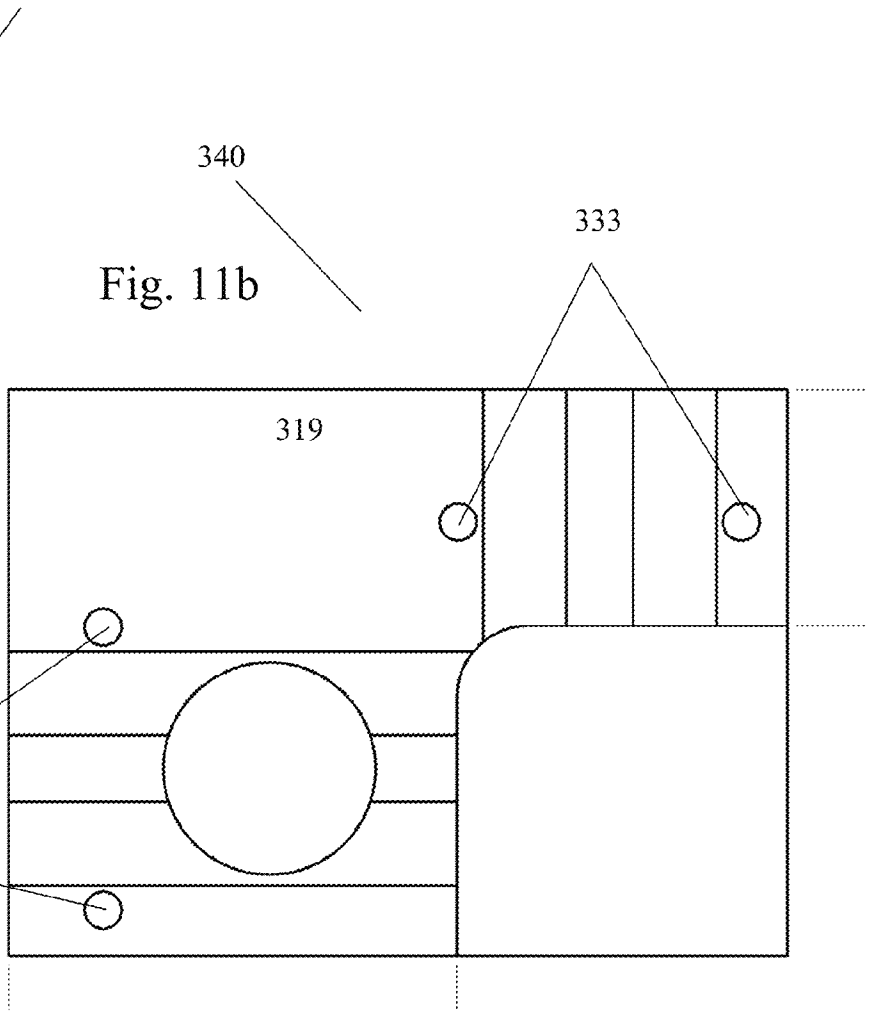
FIG. 11*b* shows a top down view of the first example of a mounting block shown in FIG. 11*a*.
Figure 11A:
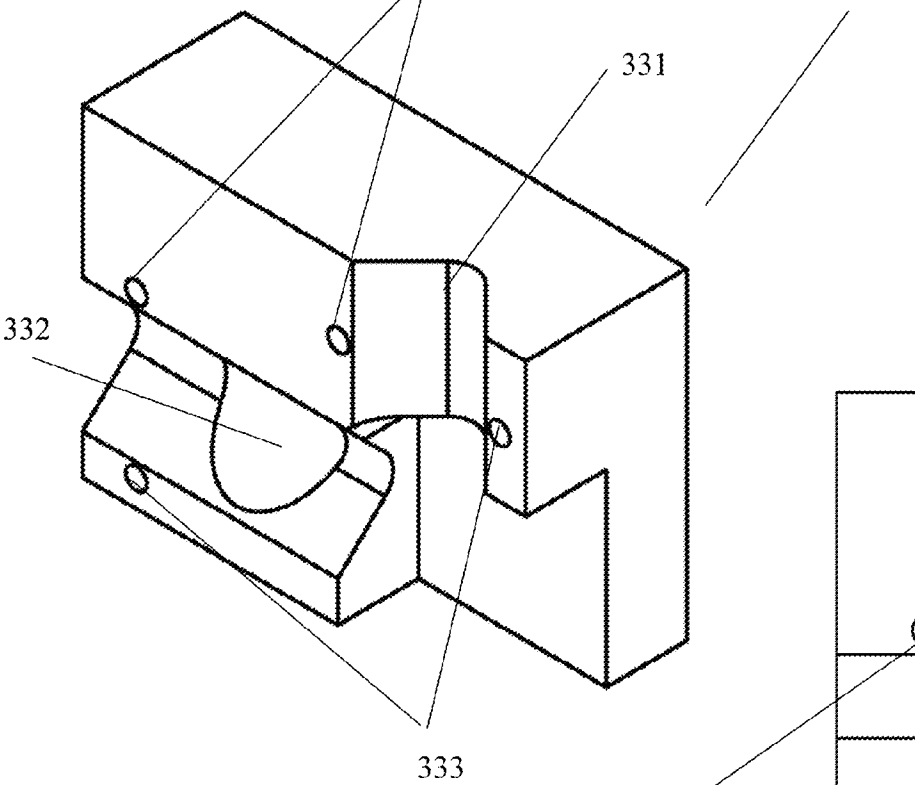
FIG. 11*a* shows a side perspective view of a first example of a mounting block for the tray apparatus in an embodiment of the present invention.
Figure 11D:
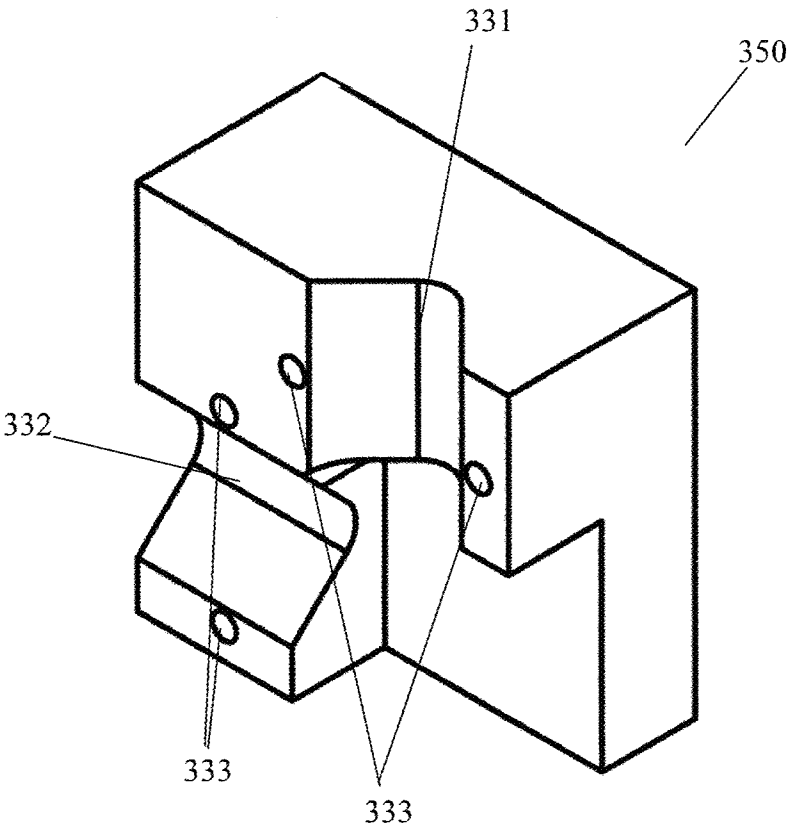
FIG. 11*d* shows a side perspective view of a second example of a mounting block for the tray apparatus in an embodiment of the present invention.
Figure 11C:
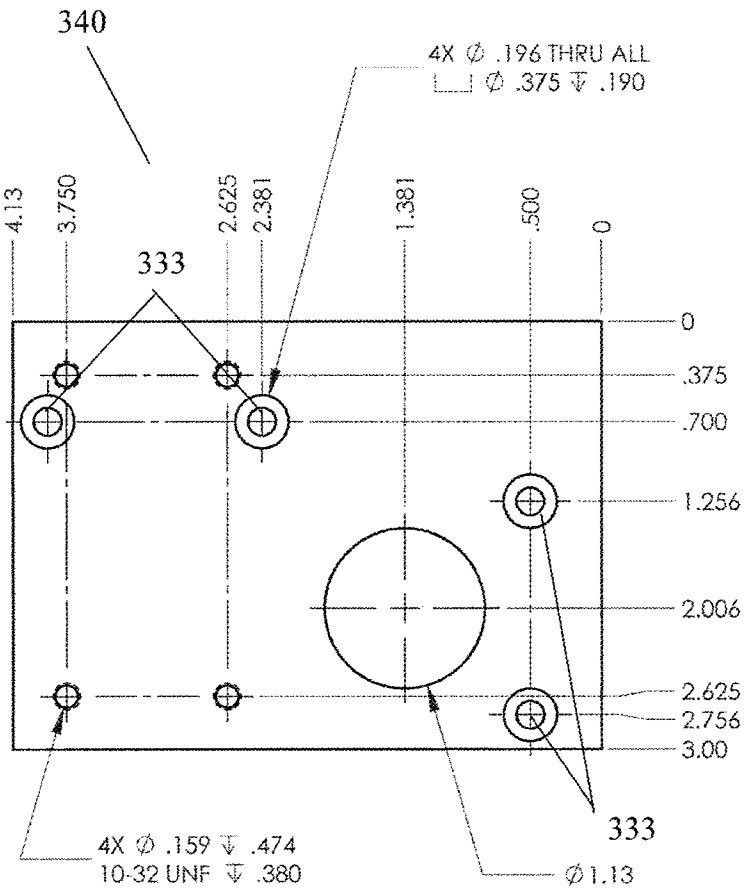
FIG. 11*c* shows a notch side view of the first example of a mounting block shown in FIG. 11*a*.
Figure 11F:
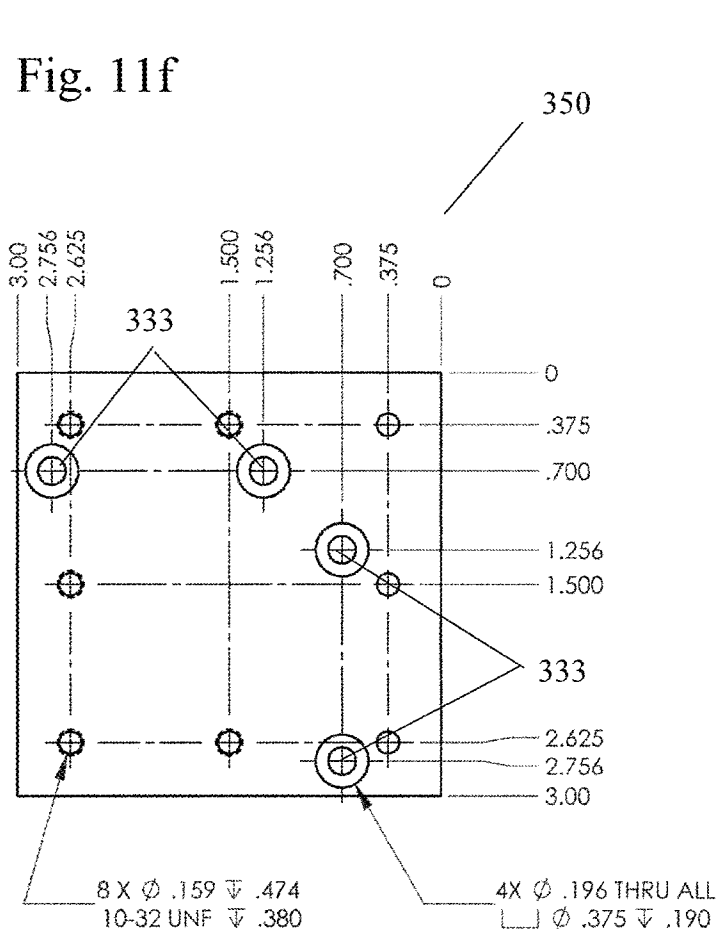
FIG. 11*f* shows a notch side view of the second example of a mounting block shown in FIG. 11*d*.
Figure 11E:
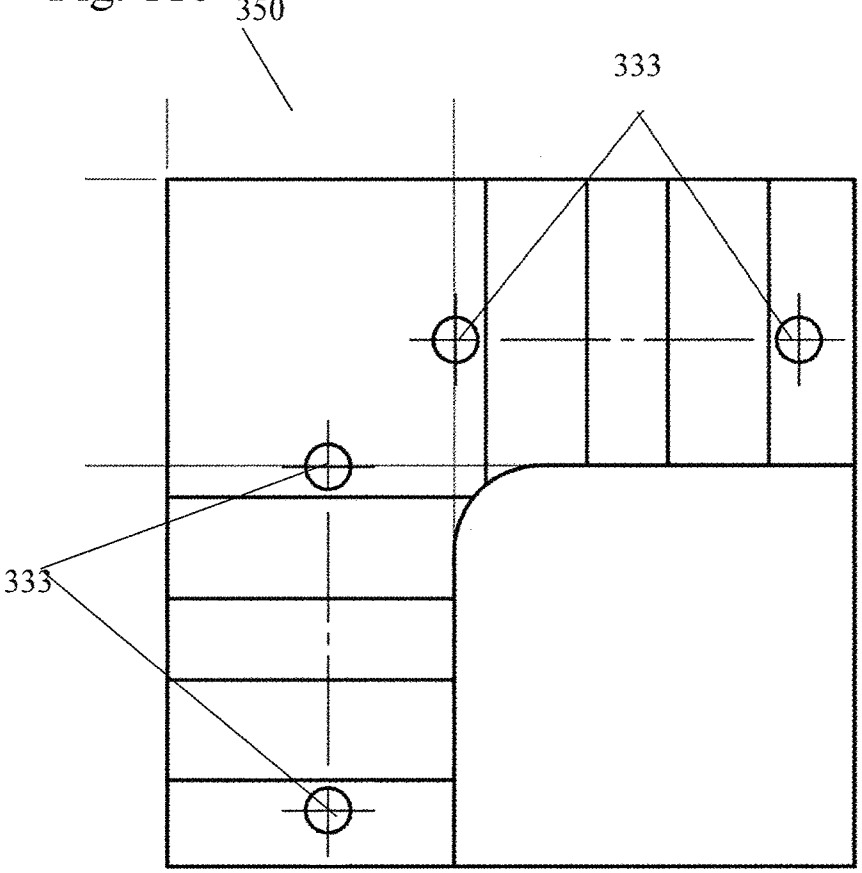
FIG. 11*e* shows a top down view of the second example of a mounting block shown in FIG. 11*d*.

The mounting blocks 330 are preferably made of aluminum. Both of the mounting blocks 340 and 350 are also shown as alternatives in FIGS. 10*c*-10*f*, but only one mounting block is preferably a part of each tray apparatus 310. The mounting block 340 is rectangular and is larger than the mounting block 350, which is preferably square. In a preferred embodiment, the mounting block 350 is a three inch square aluminum block 350. The mounting blocks 340, 350 each include a vertical notch 331 and a horizontal notch 332 for holding the vertical bar 336 and the horizontal 337 of the wheelchair 300, respectively. Each of these blocks 340, 350 also each preferably include two pairs of holes 333 for fastening two clamp plates 334 to the mounting blocks 340, 350 and sandwiching the vertical 336 and horizontal 337 bars between the mounting block 340, 350 and the clamp plates 334. FIGS. 11*c* and 11*f* show some preferred dimensions for the two different mounting block 340, 350 embodiments.

Figure 11H:
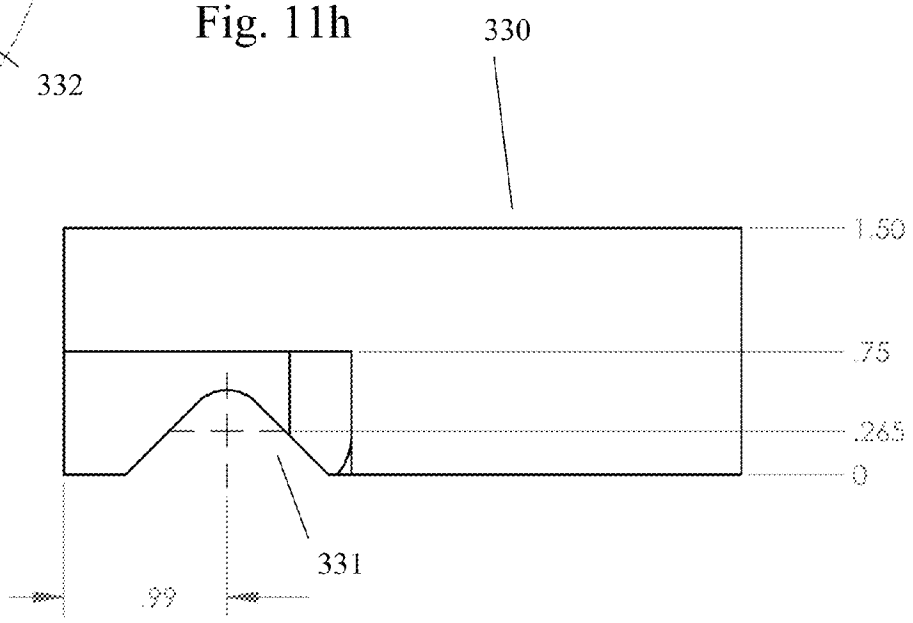
FIG. 11*h* shows a top down view of the mounting block, showing the vertical notch.
Figure 11G:
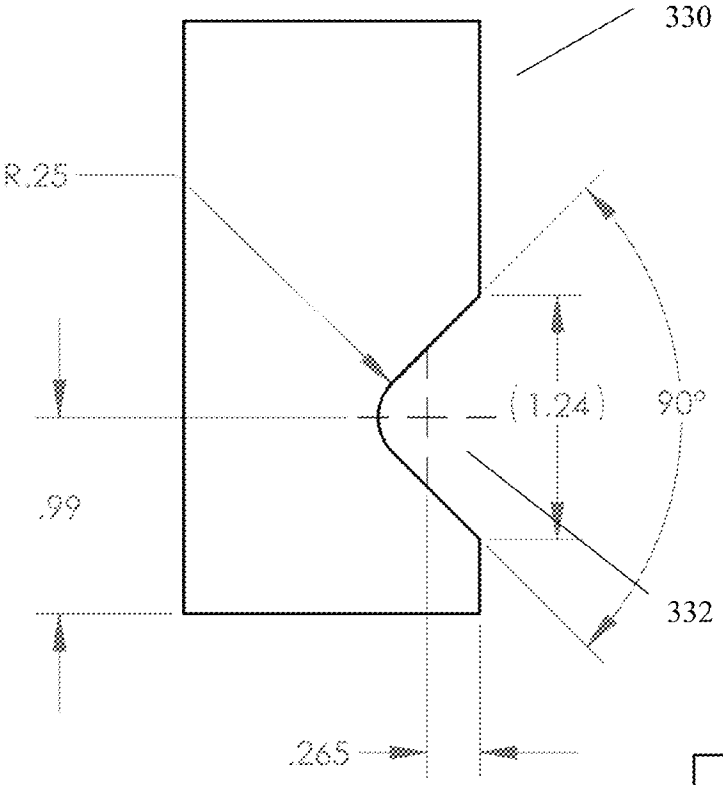
FIG. 11*g* shows a side view of the mounting block, showing the horizontal notch.

FIGS. 11*g* and 11*h* show some preferred dimensions of the horizontal notch 332 and the vertical notch 331, respectively for the mounting blocks, 330, 340, 350. The angle in FIG. 11*h* is also preferably 90 degrees. A 90 degree angle is important as the diameter of the bottom rail varies a little from wheelchair to wheelchair. A 90 degree notch allows for the difference so the mounting block can be universal.

Figure 12B:
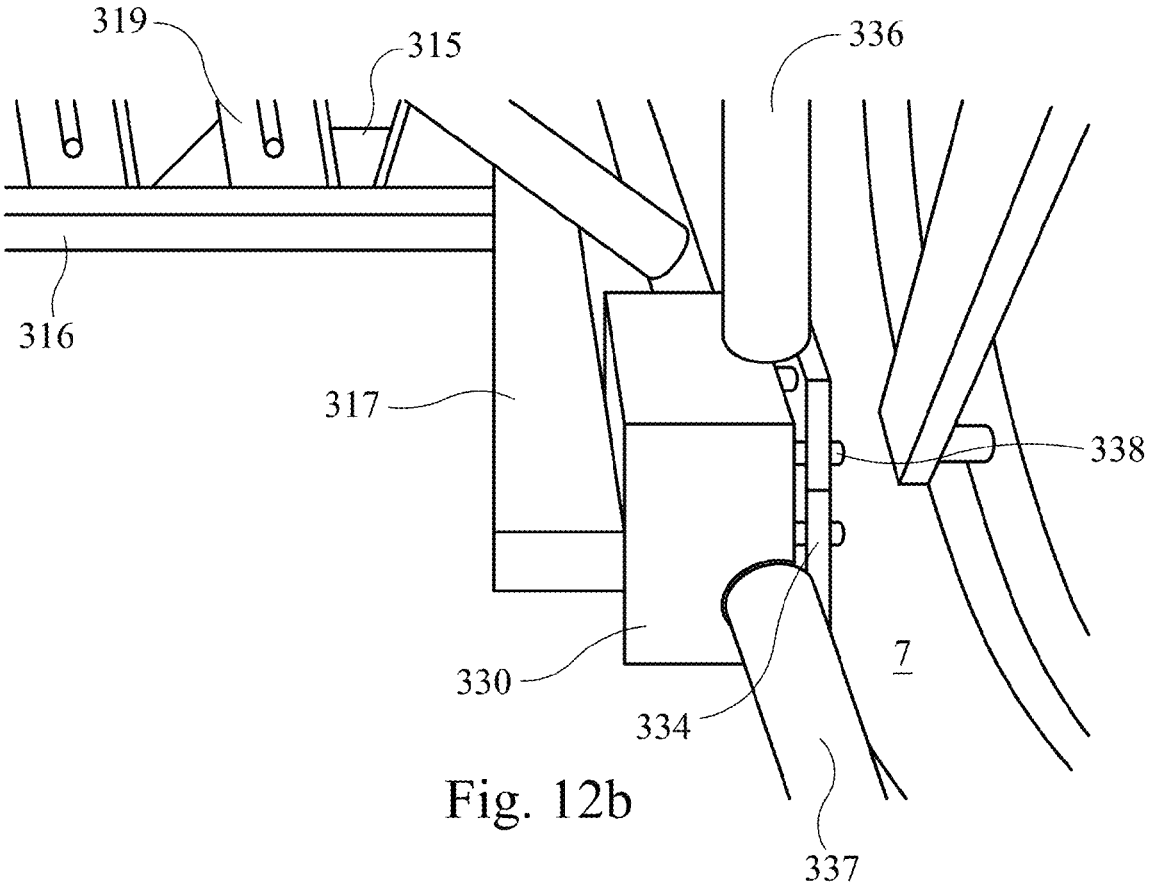
FIG. 12*b* shows a close up view of the mounting block and clamp plates of the tray apparatus on a wheelchair.
Figure 12C:
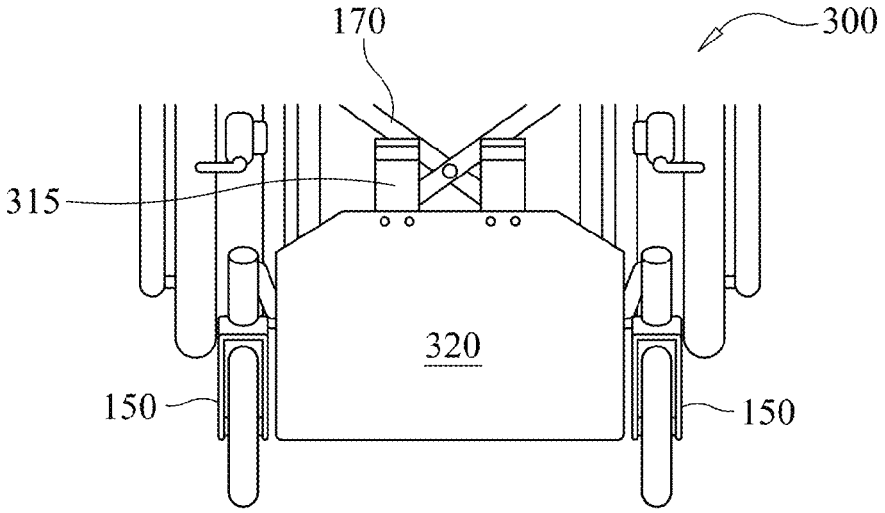
FIG. 12*c* shows a view of the tray of the tray apparatus of FIG. 12*a* folded under the wheelchair.
Figure 12E:
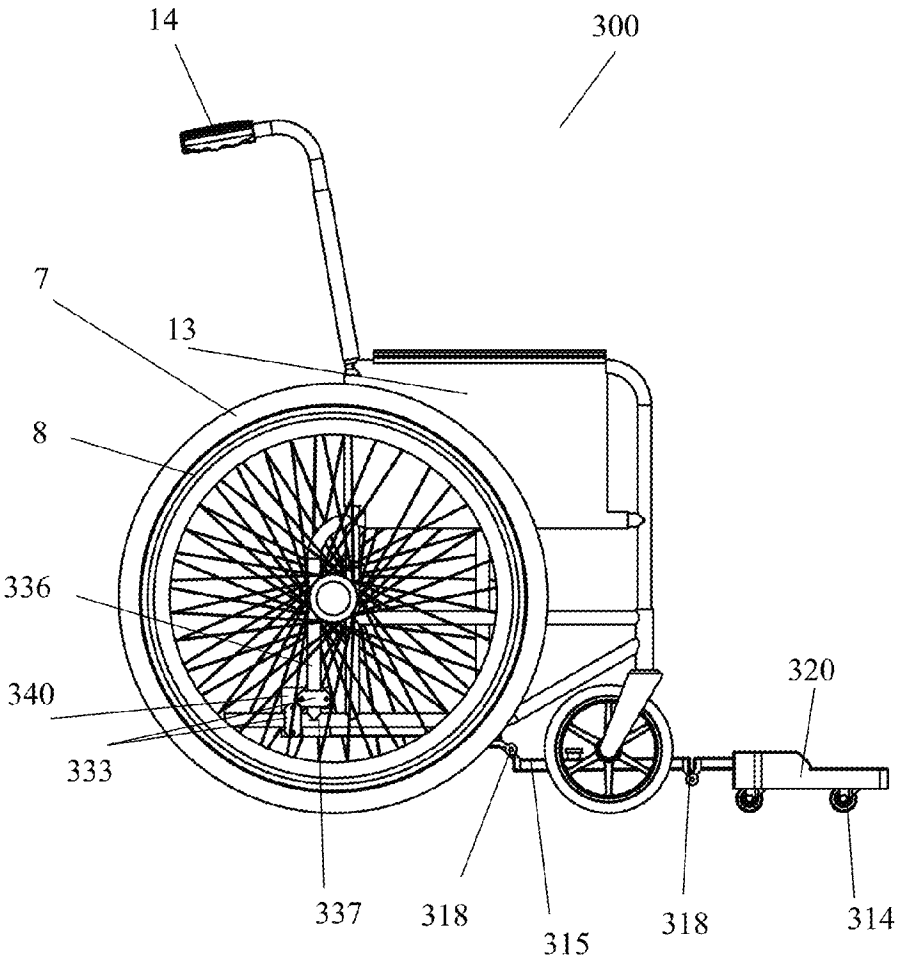
FIG. 12*e* shows a side perspective view of a wheelchair with the tray apparatus.
Figure 12D:
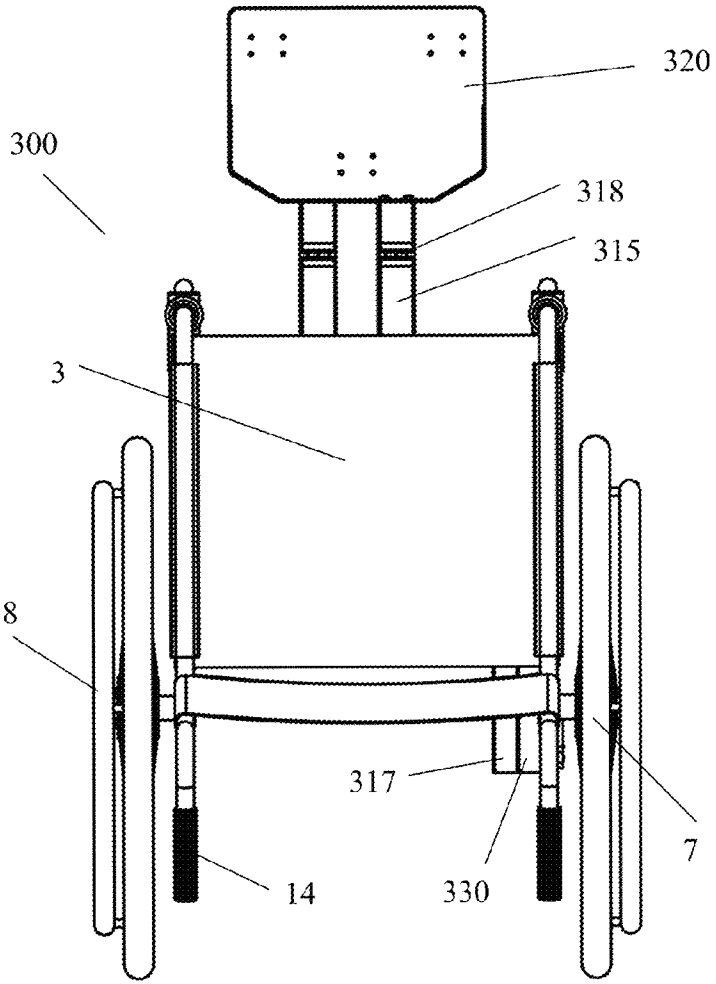
FIG. 12*d* shows a top down view of a wheelchair with the tray apparatus.

An arm 317, preferably made of aluminum, attaches to the mounting block 330, preferably using one or more fasteners 339. The arm 317 also attaches to a second arm 316, placed perpendicular to the first arm 317. The second arm 316 attaches to two additional arms 315, with vertical portions 319 of each of the additional arms 315 spaced evenly from each other and located at approximately a center of the second arm 316. The two arms 315 also each include a horizontal portion 322 that connects to the vertical portion 319 via a hinge 318, and is preferably fastened to a tray 320 by at least one fastener 321 on an end of the horizontal portion 322 opposite the hinges 318. The fasteners 321 preferably permit the tray 320 to be easily unfastened from the arms 315 such that the tray apparatus 310 without the tray can be easily stored under the wheelchair 300 with or without the tray 320. There are also preferably at least one additional set of hinges 318 on the horizontal portion 322 of the two arms 315, which allow the tray 320 to fold under the wheelchair 300 when not in use, as shown in FIG. 12*c*. The hinges 318 preferably include nylon bushings, which permit the tray apparatus to ride smoothly over various floor types. For example, the tray apparatus 310 is able to go over carpets smoothly.

In one preferred embodiment, the tray 320 has a slight taper so there is less chance of interfering with the casters 150. Retraction of the tray 320 may be limited with small wheelchairs 300 because the tray 320 needs to clear the casters 150 of the wheelchair 300. For taller people using the wheelchair 300, the two arms 315 can be made longer, especially in smaller model wheelchairs 300.

Similar to the tray 120 in earlier embodiments, the tray 320 preferably includes at least two casters or wheels 314. While the tray 320 is shown as six-sided in the figures, the tray could be of any size and shape that would effectively hold a person's feet while in the wheelchair 300.

In one preferred embodiment, the tray in its folded position is held secure by one or more magnets 323, which are shown in FIGS. 10*a* and 10*b*. In one preferred embodiment, the magnets 323 are preferably approximately nickel size. In other preferred embodiments, the magnets are preferably neodymium rare earth magnets. In one preferred embodiment, the magnets are disc-shaped or ring magnets. In one preferred embodiments, the magnets are 1"×¼" countersunk ring magnets, preferably with a plastic coating, from K&J Magnetics (K& J Magnetics, Inc., Jamison, Pa.).

Figure 13B:
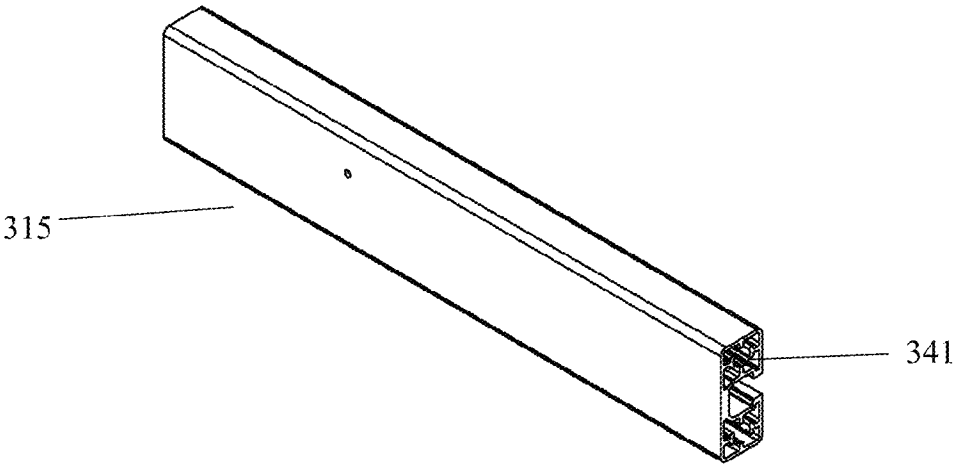
FIG. 13*b* shows a side perspective view of the two arms of FIG. 13*a*.
Figure 13A:
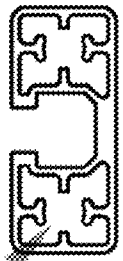
FIG. 13*a* shows a cross-sectional view of the two arms of the tray apparatus that connect to the tray.

FIGS. 13*a* and 13*b* show a preferred design for the arms 315. The design has a cross-section with an interior shape 341 shown in FIG. 13*a*. The cross-section shows a groove through the middle of the arms. An alien wrench can be used to adjust the distance that these arms 315 extend during use, thereby allowing the tray 320 to retract or extend as needed. These arms are preferably made of aluminum, although other sturdy materials, such as plastic or steel could be used. Other designs that have the strength to withstand weight are also possible.

Figure 14A:
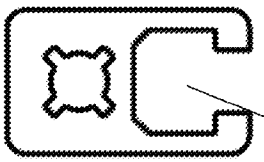
FIG. 14*a* shows a cross-sectional view of the other arms of the tray apparatus.
Figure 14B:
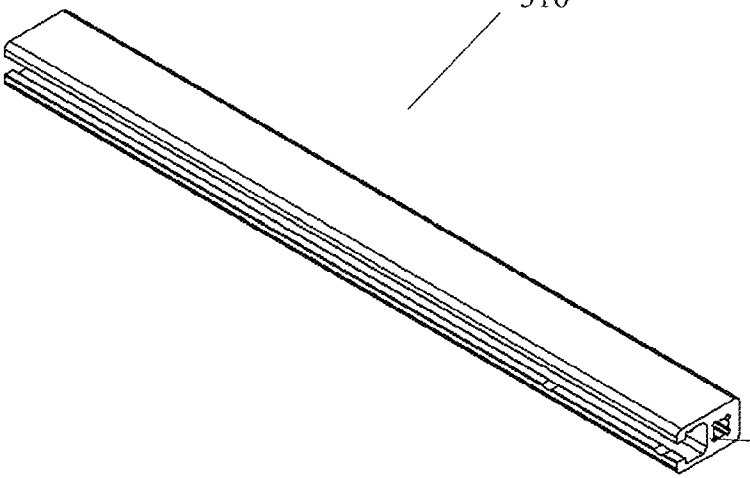
FIG. 14*b* shows a side perspective view of the arms of FIG. 14*a*.

FIGS. 14*a* and 14*b* show a preferred design for the arms 316, 317. Either or both of the arms 316, 317 preferably have this design for the beam or arm 316, 317. The design has a cross-section with an interior shape 342 shown in FIG. 14*a*. These arms are preferably made of aluminum, although other sturdy materials, such as plastic or steel could be used. Other designs that have the strength to withstand weight are also possible.

In one preferred embodiment, the arms 315, 316, 317 are made of MiniTec T-slotted aluminum profiles (MiniTec Framing Systems, LLC, Victor, N.Y.), like the cross-sections shown in FIGS. 13*a* and 14*a*. This permits the arms to connect to each other without the need for fasteners and also permits easy adjustment of the arms. In embodiments using MiniTec arms, the arms have set screws that are fit to an alien wrench. The screws allow for adjustments to raise or lowering any of the arms 315, 316, 317. The arms 315, 316, 317 are connected by their hinges. The set screws are out of reach in the channels of the arms 315, 316, 317 so they can not be tampered with by accident. In other preferred embodiments, the hinges 318 are preferably made by MiniTec (MiniTec Framing Systems, LLC, Victor, N.Y.).

However, other types and materials of bars, rods, or tubes, for example steel, aluminum, or sturdy plastic, could be used for the arms 115, 116, 315, 316, 317 in any of the embodiments described herein.

Figure 15B:
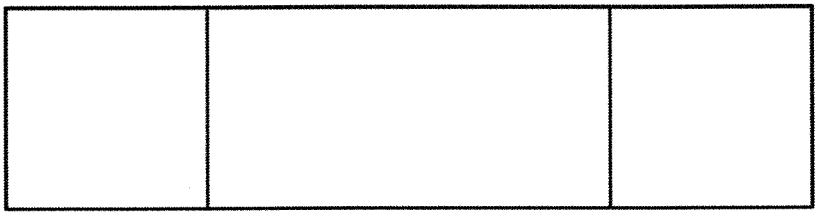
FIG. 15*b* shows a side view of the clamp plate of FIG. 15*a*.
Figure 15A:
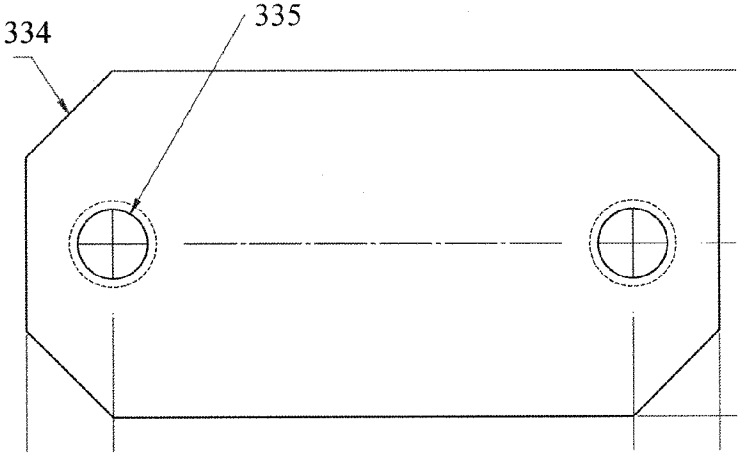
FIG. 15*a* shows an example of a clamp plate that fastens to the mounting block in an embodiment of the invention.
Figure 15C:
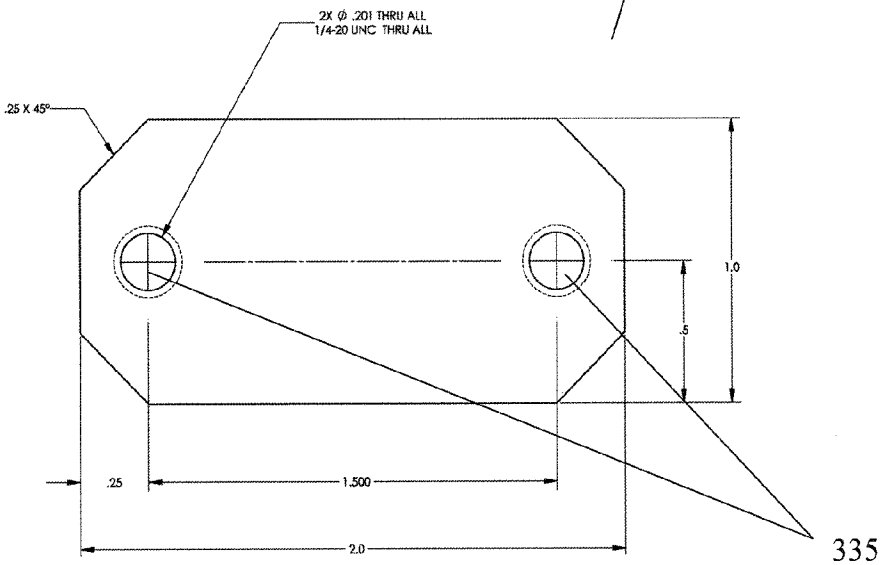
FIG. 15*c* shows the clamp plate of FIG. 15*a* with some preferred dimensions.

FIGS. 15*a* through 15*c* show a clamp plate 334. Some preferred dimensions for the clamp plate 334 are shown in FIG. 15*c*. In one preferred embodiment, the width of the clamp plate (shown in FIG. 15*b*) is preferably 0.25 inches. Although the shape is shown as an octagon in the figure, the clamp plate can be of any shape that effectively clamps the wheelchair bars between the clamp plate and the mounting block. For example, the clamp plate could be oval or rectangular. In preferred embodiments, two clamp plates are used. Each clamp plate 334 preferably has two holes, so that four fasteners 339, or screws, go through the block 330 to hold the wheelchair bars 331 and 332 in place between the block 330 and the clamp plates 334. In preferred embodiments, each clamp plate is a one inch aluminum plate.

The fasteners 339 that attach the arm 317 to the mounting block 330 are preferably the same type of fasteners 339 that are used to clamp the clamp plate 334 to the block 330.

Similar to the first embodiment, the tray device in this embodiment folds up into dead space under wheelchair. This is accomplished using the hinges 318 on the arms 315.

In one preferred embodiment, the universal tray device includes a remote control that controls the tray. The remote control allows the tray to be extended, adjusting the extension, or put into a storage position under the wheelchair. In one preferred embodiment, the remote control unfolds the tray 120, 320 from the stored position under the seat 3 and extend the length of the tray 120, 320 to the correct length for the person using the wheelchair 100, 300.

In one alternative embodiment, instead of a tray, foot sliders can be put on the user's feet, to slide them along the floor. These sliders may be similar to furniture sliders attached to easily slip on and slip off shoes, such as flip flops.

In one preferred embodiment, the tray is in a storage bag on the side of the wheelchair, to take it on or off.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A universal tray apparatus for a wheelchair comprising:

a) a tray that is shaped to hold both feet of a user;

b) at least one tray arm reversibly attached to the tray, wherein the arm has a length that retracts and extends;

c) at least one mounting block that reversibly attaches to at least one bar of the wheelchair and comprises a vertical notch extending partially around a vertical bar of the wheelchair and a horizontal notch extending partially around a horizontal bar of the wheelchair; and d) at least one tray connecting component that connects the tray arm to the mounting block.

2. The universal tray apparatus of claim 1, wherein the tray connecting component comprises a first connecting arm connecting to the tray arm and a second connecting arm connecting to the first connecting arm and the mounting block.

3. The universal tray apparatus of claim 2, wherein the tray arm comprises two tray arms, each tray arm fastened to the first connecting arm and reversibly connected to the tray.

4. The universal tray apparatus of claim 1, further comprising a first clamp plate fastening to the mounting block in a substantially vertical direction to secure the vertical bar between the mounting block and the first clamp plate.

5. The universal tray apparatus of claim 4, further comprising a second clamp plate fastening to the mounting block in a substantially horizontal direction to secure the horizontal bar between the mounting block and the second clamp plate.

6. The universal tray apparatus of claim 1, further comprising a clamp plate fastening to the mounting block in a substantially horizontal direction to secure the horizontal bar between the mounting block and the clamp plate.

7. The universal tray apparatus of claim 1, further comprising at least one magnet holding the tray apparatus in a folded position under the wheelchair.

8. The universal tray apparatus of claim 1, wherein the tray arm comprises at least one hinge such that the tray arm is foldable into a folded position under the wheelchair.

9. The universal tray apparatus of claim 1, wherein the tray is detachable from the tray arm.

10. The universal tray apparatus of claim 1, wherein b), c) and d) are made of aluminum and the tray is made of plastic.

11. A universal tray apparatus for a wheelchair comprising:

a) a tray that is shaped to hold both feet of a user;

b) at least one tray arm reversibly attached to the tray, wherein the arm has a length that retracts and extends and comprises at least one hinge such that the tray arm is foldable into a folded position under the wheelchair;

c) at least one mounting block that reversibly attaches to at least one bar of the wheelchair; and d) at least one tray connecting component that connects the tray arm to the mounting block.

12. The universal tray apparatus of claim 11, further comprising at least one magnet holding the tray apparatus in the folded position under the wheelchair.

13. The universal tray apparatus of claim 11, wherein the tray is detachable from the tray arm.

14. The universal tray apparatus of claim 11, wherein b), c) and d) are made of aluminum and the tray is made of plastic.

15. The universal tray apparatus of claim 11, wherein the tray connecting component comprises a first connecting arm connecting to the tray arm and a second connecting arm connecting to the first connecting arm and the mounting block.

* * * * *